US007987827B2

(12) United States Patent
Fujiyoshi et al.

(10) Patent No.: US 7,987,827 B2
(45) Date of Patent: Aug. 2, 2011

(54) VALVE TIMING CONTROL APPARATUS

(75) Inventors: Toshiki Fujiyoshi, Okazaki (JP); Osamu Sato, Takahama (JP)

(73) Assignee: Denso Corporation, Kariya (JP)

( * ) Notice: Subject to any disclaimer, the term of this patent is extended or adjusted under 35 U.S.C. 154(b) by 291 days.

(21) Appl. No.: 12/325,008

(22) Filed: Nov. 28, 2008

(65) Prior Publication Data

US 2009/0133652 A1 May 28, 2009

(30) Foreign Application Priority Data

Nov. 28, 2007 (JP) ..... 2007-307987

(51) Int. Cl.
*F01L 1/34* (2006.01)

(52) U.S. Cl. ..... 123/90.17; 123/90.12; 123/90.15; 464/160

(58) Field of Classification Search ..... 123/90.12, 123/90.13, 90.15, 90.16, 90.17, 90.18; 464/1, 464/2, 160

See application file for complete search history.

(56) References Cited

U.S. PATENT DOCUMENTS 7,124,722 B2 10/2006 Smith
2009/0071426 A1 3/2009 Knecht et al.

FOREIGN PATENT DOCUMENTS

JP 2006-63835 3/2006
JP 2007-138744 6/2007

OTHER PUBLICATIONS

Japanese Office Action dated Nov. 4, 2009, issued in corresponding Japanese Application No. 2007-307987, with English translation.
Japanese Office Action dated Mar. 16, 2010, issued in corresponding Japanese Application No. 2007-307987, with English translation.

*Primary Examiner* — Ching Chang
(74) *Attorney, Agent, or Firm* — Nixon & Vanderhye PC

(57) ABSTRACT

A valve timing control apparatus for controlling valve timing includes a first rotor, a second rotor, and a controller. The second rotor and the first rotor defines therebetween an advance chamber and a retard chamber. The controller includes a supply passage, at least one drain passage, a spool valve, at least one connection passage, and at least one check valve. The at least one connection passage connects the supply passage to the at least one drain passage when a spool of the spool valve is moved to one of the advance and retard positions. The at least one check valve is respectively provided in the at least one connection passage. The check valve allows working fluid to flow in a direction from the at least one drain passage toward the supply passage and limits working fluid from flowing in an opposite direction.

16 Claims, 34 Drawing Sheets

VALVE TIMING CONTROL APPARATUS

CROSS REFERENCE TO RELATED APPLICATION

This application is based on and incorporates herein by reference Japanese Patent Application No. 2007-307987 filed on Nov. 28, 2007.

BACKGROUND OF THE INVENTION

1. Field of the Invention

The present invention relates to a valve timing control apparatus for controlling valve timing of a valve that is opened and closed by a camshaft through torque transmitted from a crankshaft in an internal combustion engine.

2. Description of Related Art

Conventionally, a hydraulic valve timing control apparatus, having a housing serving as a first rotor rotatable with a crankshaft and a vane rotor serving as a second rotor rotatable with a camshaft, is widely used. As one type of such valve timing control apparatus, JP-2006-63835A discloses an apparatus for valve timing control, which supplies working fluid to advance chambers or retard chambers formed in a rotation direction between shoes (lobes) of the housing and vanes of the vane rotor in order to drive the camshaft in an advance direction or in a retard direction with respect to the crankshaft.

More particularly, in the apparatus disclosed in JP-2006-63835A, a spool valve controls a connection state of each of a supply passage and a drain passage with a corresponding one of the advance chamber and the retard chamber. In the above, the supply passage allows working fluid supplied from a pump to flow therethrough, and the drain passage allows discharged working fluid to flow therethrough. For example, when a phase of the camshaft with respect to the crankshaft (hereinbelow, referred to as an "engine phase") is changed in the advance direction, the supply passage is connected to the advance chamber, and the drain passage is connected to the retard chamber by movement of a spool in the spool valve. On the other hand, when the engine phase is changed in the retard direction, the connection relations of the respective passages are reversed by the movement of the spool in the spool valve.

As disclosed in JP-2006-63835A, generally, in a valve timing control apparatus, variable torque moves or displaces the camshaft in the advance direction and the retard direction with respect to the crankshaft. The variable torque is always caused by a reaction force or the like of a valve spring for a valve that is opened and closed with the camshaft during running of the internal combustion engine. The torque varies in correspondence with rotational state of the internal combustion engine.

Accordingly, for example, it is supposed an operational state, where the engine phase is changed in the advance direction and at the same time the variable torque is applied in a direction to advance the camshaft. In the above, the volume of the advance chamber is expanded or increased by the action of the above torque in the advance direction. As a result, when the amount of fluid supply from the pump is relatively small, the working fluid may become insufficient in the advance chamber disadvantageously. Accordingly, when the application direction of the variable torque is reversed, the shortage of the working fluid in the chamber may cause and the retard of the camshaft, and as a result, the response in the advance operation may be degraded disadvantageously.

SUMMARY OF THE INVENTION

The present invention is made in view of the above disadvantages. Thus, it is an objective of the present invention to address at least one of the above disadvantages.

To achieve the objective of the present invention, there is provided a valve timing control apparatus for controlling valve timing of a valve that is opened and closed by a camshaft through torque transmitted from a crankshaft in an internal combustion engine, the valve timing control apparatus including a first rotor, a second rotor, and a controller. The first rotor is rotatable with the crankshaft. The second rotor is rotatable with the camshaft. The second rotor and the first rotor define therebetween an advance chamber and a retard chamber, which are circumferentially arranged one after another. The second rotor drives the camshaft with respect to the crankshaft in an advance direction when working fluid is supplied to the advance chamber. The second rotor drives the camshaft with respect to the crankshaft in a retard direction when working fluid is supplied to the retard chamber. The controller includes a supply passage, first and second drain passages, a spool valve, at least one connection passage, and at least one check valve. Working fluid is supplied through the supply passage from an external fluid supply source. Working fluid is discharged through the first and second drain passages, wherein the controller controls a connection state of each of the supply passage and the first and second drain passages with a corresponding one of the advance chamber and the retard chamber. The spool valve includes a spool, which is reciprocably movable. The spool valve connects the supply passage to the advance chamber and connects the first drain passage to the retard chamber by moving the spool to an advance position in order to advance a phase of the camshaft with respect to the crankshaft. The spool valve connects the supply passage to the retard chamber and connects the second drain passage to the advance chamber by moving the spool to a retard position in order to retard the phase. The at least one connection passage connects the supply passage to a corresponding one of the first and second drain passages when the spool is moved to one of the advance position and the retard position. The at least one check valve is provided respectively in the at least one connection passage. The at least one check valve allows working fluid to flow in a first direction from the corresponding one of the first and second drain passages toward the supply passage. The at least one check valve limits working fluid from flowing in a second direction from the supply passage toward the corresponding one of the first and second drain passages.

BRIEF DESCRIPTION OF THE DRAWINGS

The above and other object, features and advantages of the present invention will become more apparent from the following detailed description when taken in conjunction with the accompanying drawings in which.

DETAILED DESCRIPTION OF PREFERRED EMBODIMENTS

Hereinbelow, preferred embodiments of the present invention will now be described in accordance with the accompanying drawings.

First Embodiment

Figure 1:
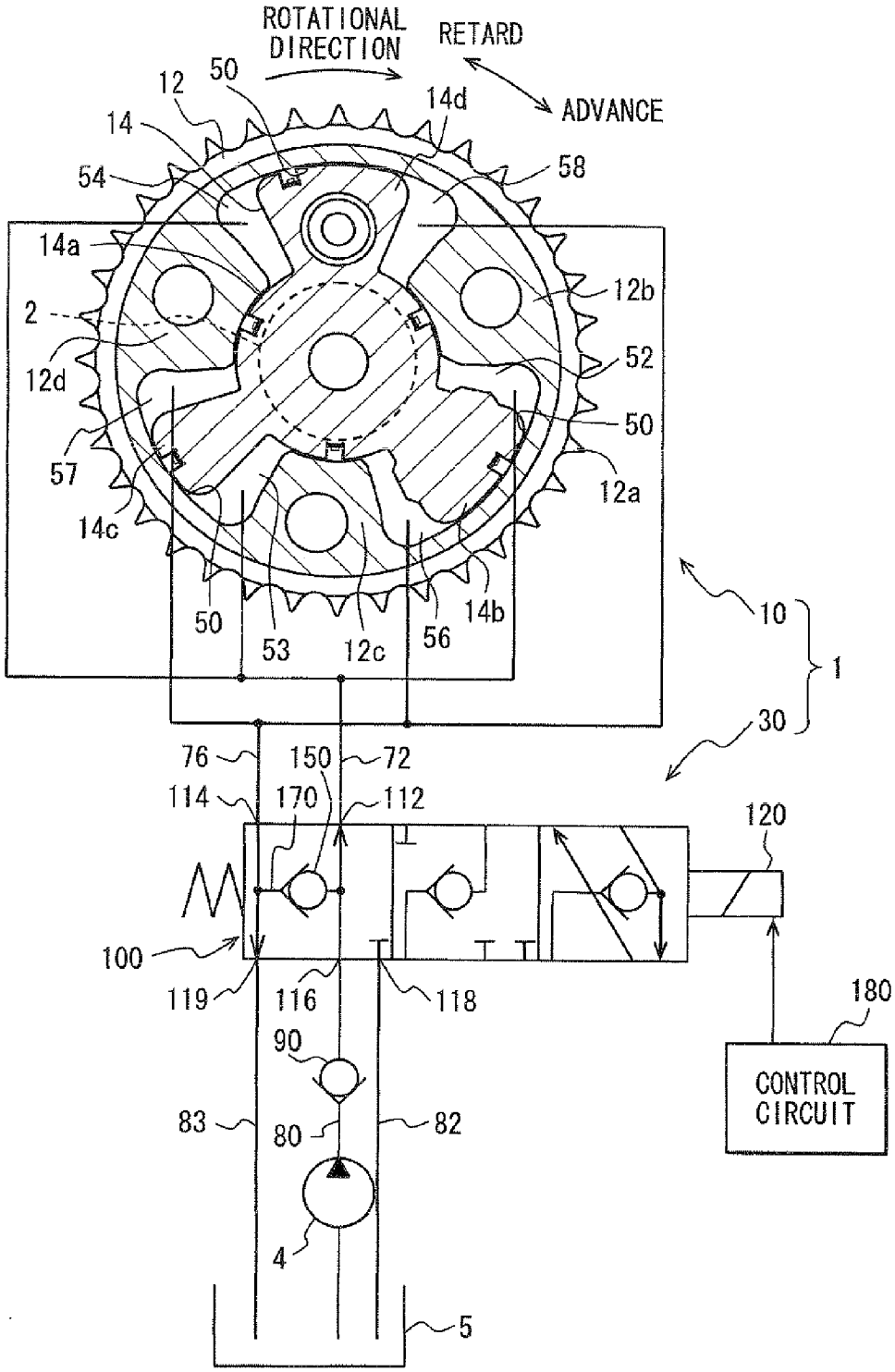
FIG. 1 is a block diagram showing a valve timing control apparatus according to a first embodiment of the present invention.

FIG. 1 shows an example in which a valve timing control apparatus 1 according to a first embodiment of the present invention is applied to a vehicle internal combustion engine. The valve timing control apparatus 1 which is a hydraulic apparatus using hydraulic oil serving as "working fluid" controls valve timing of an intake valve serving as a "valve".

(Basic Components)

Hereinbelow, basic components of the valve timing control apparatus 1 will be described. The valve timing control apparatus 1 has a driving unit 10 and a controller 30. The driving unit 10 is provided in a driving force transmission system to transmit a driving force of a crankshaft (not shown) of the internal combustion engine to a camshaft 2 of the internal combustion engine, and is driven with hydraulic oil. The controller 30 controls supply of hydraulic oil to the driving unit 10.

(Driving Unit)

In the driving unit 10, a housing 12 has a cylindrical sprocket 12*a*, and multiple shoes (or lobes) 12*b* to 12*d* serving as partition members.

The sprocket 12*a* is coupled to the crankshaft via a timing chain (not shown). In this arrangement, during running of the internal combustion engine, because the driving force is transmitted from the crankshaft to the sprocket 12*a*, the housing 12 is rotated with the crankshaft in the clockwise direction in FIG. 1.

The respective shoes 12*b* to 12*d* are arranged in the sprocket 12*a* at positions at approximately equal intervals in the rotation direction and project from the sprocket 12*a* inwardly in a radial direction from above arranged positions. In the respective shoes 12*b* to 12*d*, an end surface on the projected side has an arcuate concave shape viewed in an axial direction of the housing 12, and the end surface is in slide-contact with an outer peripheral wall surface of a boss 14*a* of a vane rotor 14. Each chamber 50 is respectively formed between adjacent ones of the shoes 12*b* to 12*d*, which adjacent ones are arranged adjacently in the rotation direction.

The vane rotor 14, accommodated in the housing 12, is in slide-contact with the housing 12 in an axial direction. The vane rotor 14 has the columnar boss 14*a* and vanes 14*b* to 14*d*.

The boss 14*a* is coaxially fixed to the camshaft 2 through a bolt. In this arrangement, the vane rotor 14 is rotated with the camshaft 2 in the clockwise direction in FIG. 1 and is relatively rotatable with respect to the housing 12.

The respective vanes 14*b* to 14*d* are arranged at positions of the boss 14*a* at approximately equal intervals in the rotation direction and projected outward in the radial direction from the above positions. The vanes 14*b* to 14*d* are accommodated in respectively corresponding chambers 50. In the respective vanes 14*b* to 14*d*, an end surface in the projection direction has an arcuate convex shape viewed in the axial direction of the housing 12 in FIG. 1, and the end surface is in slide-contact with an inner peripheral wall surface of the sprocket 12*a*.

Each of the vanes 14*b* to 14*d* defines an advance chamber and a retard chamber between the vane and the housing 12 by partitioning the corresponding chamber 50 into halves in the rotation direction. More particularly, an advance chamber 52 is formed between the shoe 12*b* and the vane 14*b*; an advance chamber 53 is formed between the shoe 12*c* and the vane 14*c*; and an advance chamber 54 is formed between the shoe 12*d* and the vane 14*d*. Further, a retard chamber 56 is formed between the shoe 12*c* and the vane 14*b*; a retard chamber 57 is formed between the shoe 12*d* and the vane 14*c*; and a retard chamber 58 is formed between the shoe 12*b* and the vane 14*d*.

In the driving unit 10 having the above structure, the vane rotor 14 is relatively rotated in the advance direction with respect to the housing 12 by supply of hydraulic oil to the advance chambers 52 to 54, thereby the camshaft 2 is driven in the advance direction with respect to the crankshaft. Accordingly, in the above case, the valve timing is advanced. Further, in the driving unit 10, the vane rotor 14 is relatively rotated in the retard direction with respect to the housing 12 by supply of hydraulic oil to the retard chambers 56 to 58, thereby the camshaft 2 is driven in the retard direction with respect to the crankshaft. Accordingly, in the above case, the valve timing is retarded.

(Controller)

In the controller 30, an advance passage 72 is provided through the camshaft 2 and a bearing (not shown) for supporting the camshaft 2, and communicates with the advance chambers 52 to 54. Further, a retard passage 76 is provided through the camshaft 2 and the bearing for supporting the camshaft 2, and communicates with the retard chambers 56 to 58.

A supply passage 80 communicates with a discharge port of a pump 4 serving as a "fluid supply source". The hydraulic oil pumped up with the pump 4 from an oil pan 5 is pumped and supplied to the supply passage 80. Note that the pump 4 according to the present embodiment is a mechanical pump driven with the crankshaft. Accordingly, during running of the internal combustion engine, hydraulic oil is continuously supplied to the supply passage 80. Further, drain passages 82, 83 are provided such that hydraulic oil can be discharged to the oil pan 5.

The supply passage 80 has an opposite end opposite to the pump 4. The opposite end of the supply passage 80 is connected to a spool valve 100. A check valve 90 is provided in the supply passage 80 such that the check valve 90 allows fluid to flow in an valve-open direction from the pump 4 toward the spool valve 100. Accordingly, when the check valve 90 is opened, the check valve 90 allows a flow of hydraulic oil in a direction from the pump 4 to the spool valve 100. In other words, the check valve 90 allows supply of hydraulic oil to the downstream side of the supply passage 80. On the other hand, when the check valve 90 is closed, the check valve 90 regulates or limits hydraulic oil from flowing in a direction from the spool valve 100 to the pump 4. In other words, the check valve 90 regulates backflow of hydraulic oil in a direction from the downstream side of the supply passage 80.

The spool valve 100 is a solenoid control valve which linearly reciprocably drives a spool utilizing an electromagnetic driving force generated by a solenoid 120. The spool valve 100 has an advance port 112, which communicates with the advance passage 72, a retard port 114, which communicates with the retard passage 76, a supply port 116, which communicates with the supply passage 80 to receive the supply of hydraulic oil from the pump 4, and drain ports 118, 119, which communicate with the drain passages 82, 83 for discharge of hydraulic oil. Accordingly, the spool valve 100 controls each connection state of the supply port 116 and the drain ports 118, 119 with a corresponding one of the advance port 112 and the retard port 114 by reciprocating the spool in correspondence with energization of the solenoid 120.

A control circuit 180, having e.g. a microcomputer, is electrically connected to the solenoid 120 of the spool valve 100. The control circuit 180 has a function of controlling energization of the solenoid 120 and a function of controlling running of the internal combustion engine.

In the controller 30 having the above structure, the spool of the spool valve 100 is moved in accordance with energization of the solenoid 120 controlled by the control circuit 180, thereby the connection states of the ports 116, 118, 119 to the ports 112, 114 are controlled. More specifically, when the supply port 116 is connected to the advance port 112, hydraulic oil supplied from the pump 4 to the supply passage 80 is supplied via the advance passage 72 to the advance chambers 52 to 54. Further, when the supply port 116 is connected to the retard port 114, hydraulic oil supplied from the pump 4 to the supply passage 80 is supplied via the retard passage 76 to the retard chambers 56 to 58. Further, when the drain port 118 is connected to the advance port 112, hydraulic oil in the advance chambers 52 to 54 is discharged from the drain passage 82 via the advance passage 72 to the oil pan 5. Further, when the drain port 119 is connected to the retard port 114, hydraulic oil in the retard chambers 56 to 58 is discharged from the drain passage 83 via the retard passage 76 to the oil pan 5.

The basic components of the valve timing control apparatus 1 are as described above. Hereinbelow, a characteristic feature of the valve timing control apparatus 1 will be described in detail.

(Variable Torque)

Figure 2:
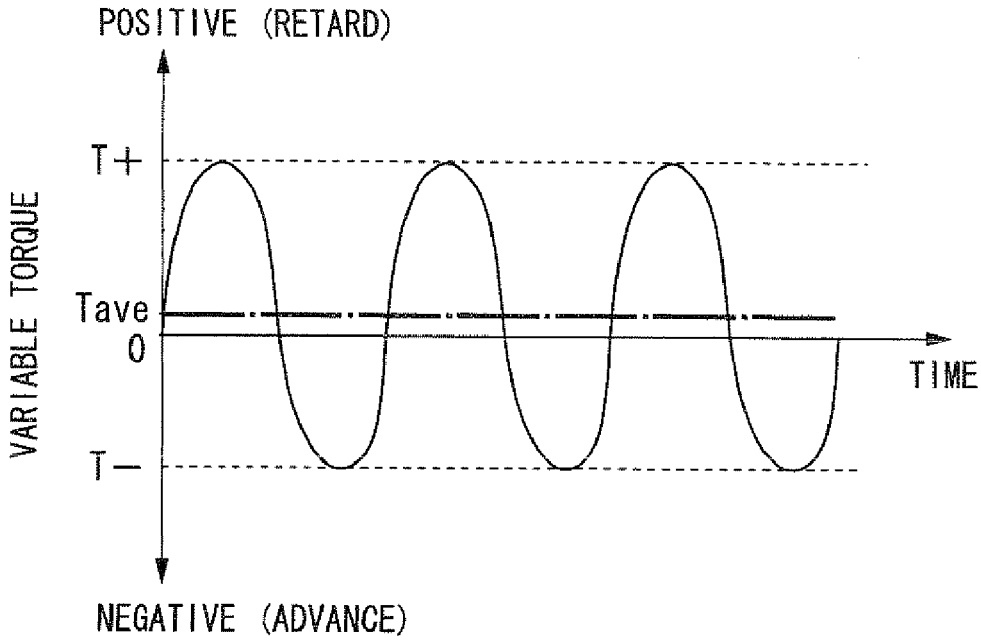
FIG. 2 is a chart explaining variable torque which acts on a driving unit in FIG. 1.

In the first embodiment, during running of the internal combustion engine, variable torque is caused by a reaction force or the like of a valve spring for the intake valve that is opened and closed by the camshaft 2, and the variable torque acts on the vane rotor 14 of the driving unit 10 through the camshaft 2. Note that as shown in FIG. 2, the variable torque periodically varies between (a) negative torque that acts in a direction to advance the camshaft 2 with respect to the crankshaft and (b) positive torque that acts in a direction to retard the camshaft 2 with respect to the crankshaft. Then, especially the variable torque in the present embodiment shows a tendency that positive peak torque T+ is higher in an absolute value than negative peak torque T−, and average torque $T_{ave}$ of the variable torque is biased to be measured in the positive value or is biased in the retard direction to retard the camshaft 2. Accordingly, there may be deterioration in responsibility in driving the camshaft 2 in a direction against the average torque $T_{ave}$ of the variable torque or in driving the camshaft 2 in the advance direction. However, as described in detail later, such concern is solved in the present embodiment. Note that the bias of the average torque $T_{ave}$ of the variable torque in the retard direction is caused by a friction between the camshaft 2 and its bearing, for example.

(Spool Valve)

Figure 3:
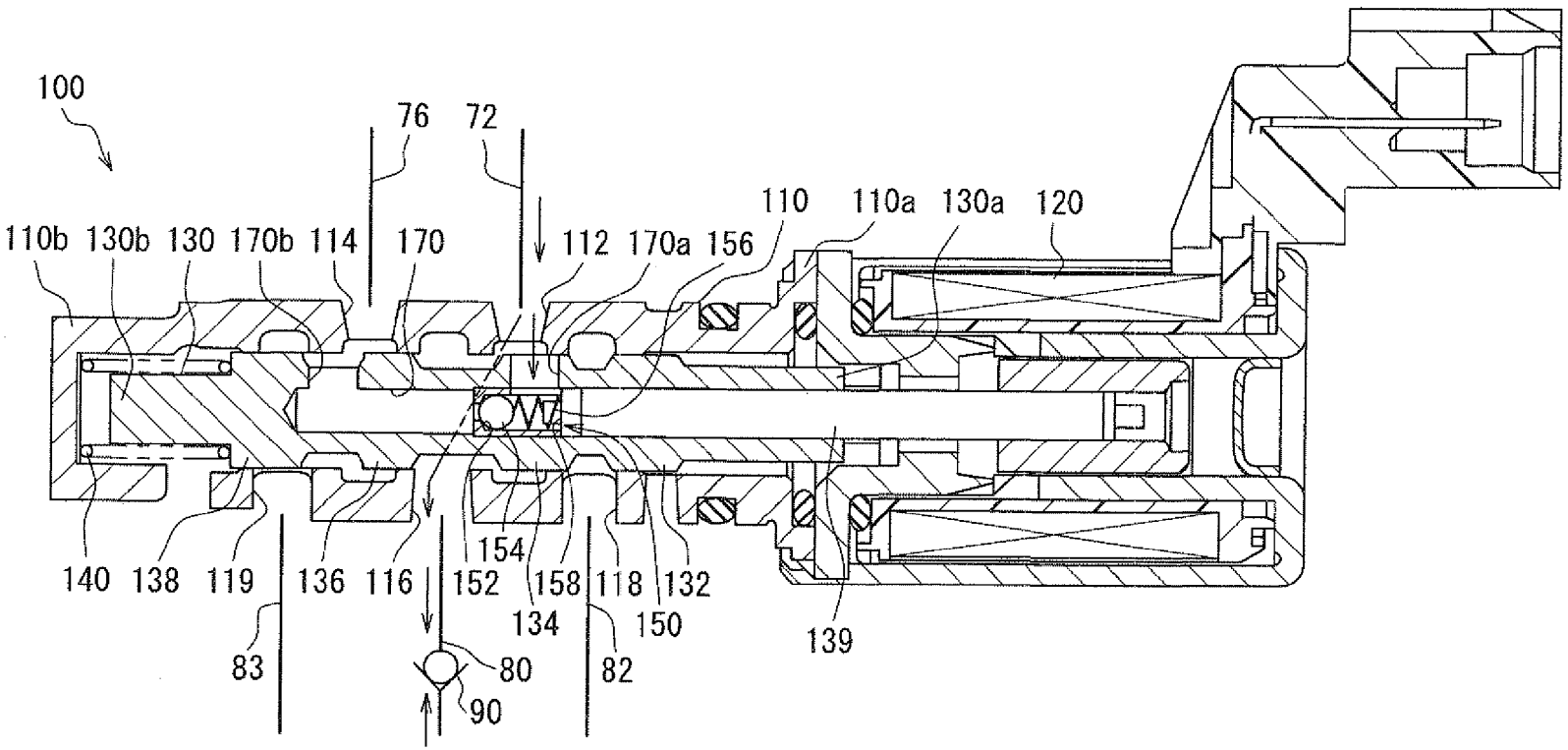
FIG. 3 is a cross-sectional view schematically showing the detailed structure and an operational state of a spool valve in FIG. 1.

As shown in FIG. 3, the spool vale 100 in the first embodiment has a sleeve 110, the solenoid 120, a spool 130, a driving shaft 139, and a return spring 140.

The sleeve 110 is a cylindrically shaped metal member. The solenoid 120 is fixed to one end 110*a* of the sleeve 110. In the sleeve 110, the drain port 118, the advance port 112, the supply port 116, the retard port 114 and the drain port 119 are arranged in this order in an axial direction from the one end 110*a* toward the other end 110*b*.

The spool 130 is a metal member accommodated coaxially in the sleeve 110 and has a column shape with multiple lands thereon. The driving shaft 139 electromagnetically driven with the solenoid 120 is coaxially coupled to one end 130*a* of the spool 130 such that the spool 130 is reciprocable with the driving shaft 139 in the axial direction. In the spool 130, an advance support land 132, an advance selection land 134, a retard selection land 136 and a retard support land 138 are arranged in this order in the axial direction from the one end 130*a* toward the other end 130*b*.

Figure 4:
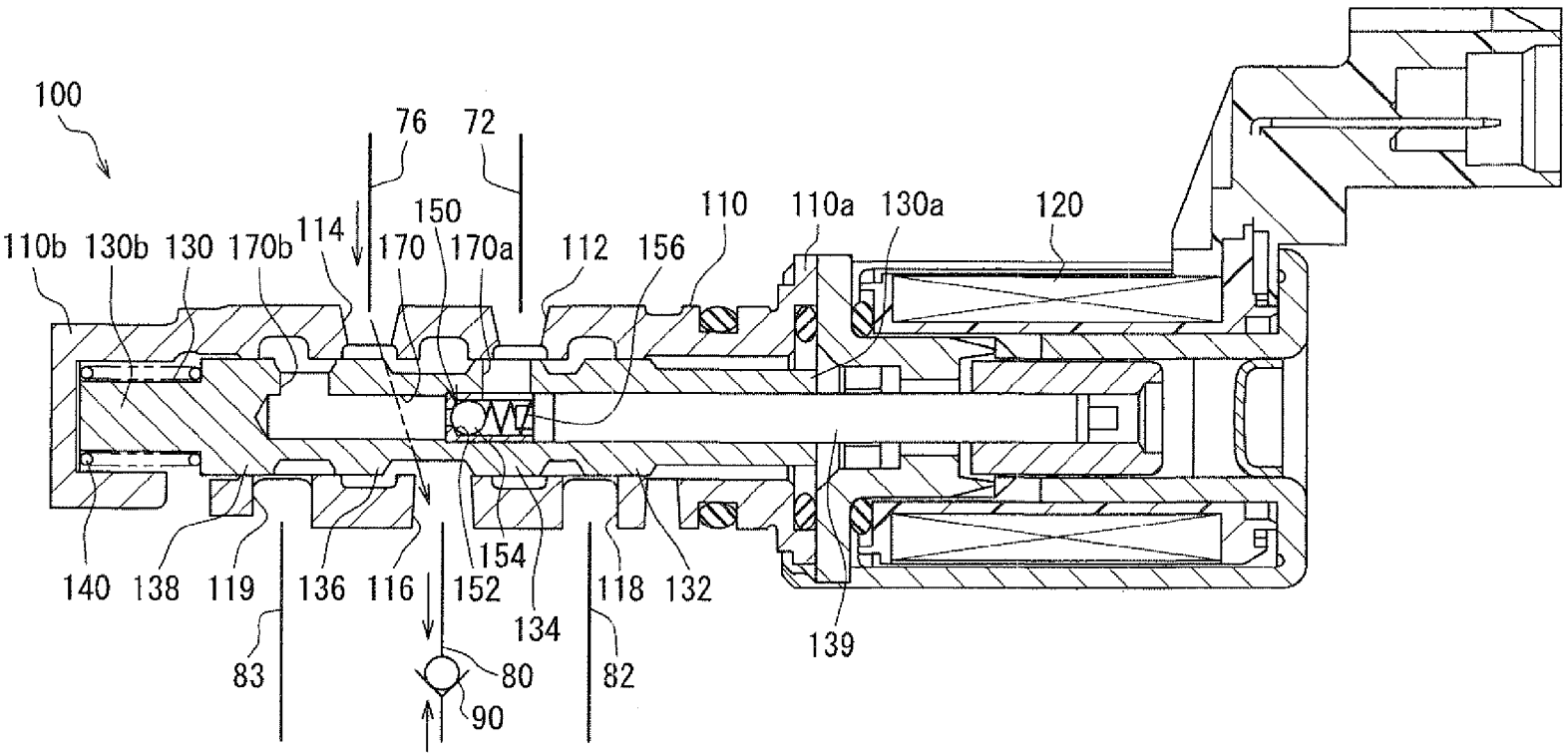
FIG. 4 is a cross-sectional view schematically showing another operational state of the spool valve in FIG. 1.
Figure 5:
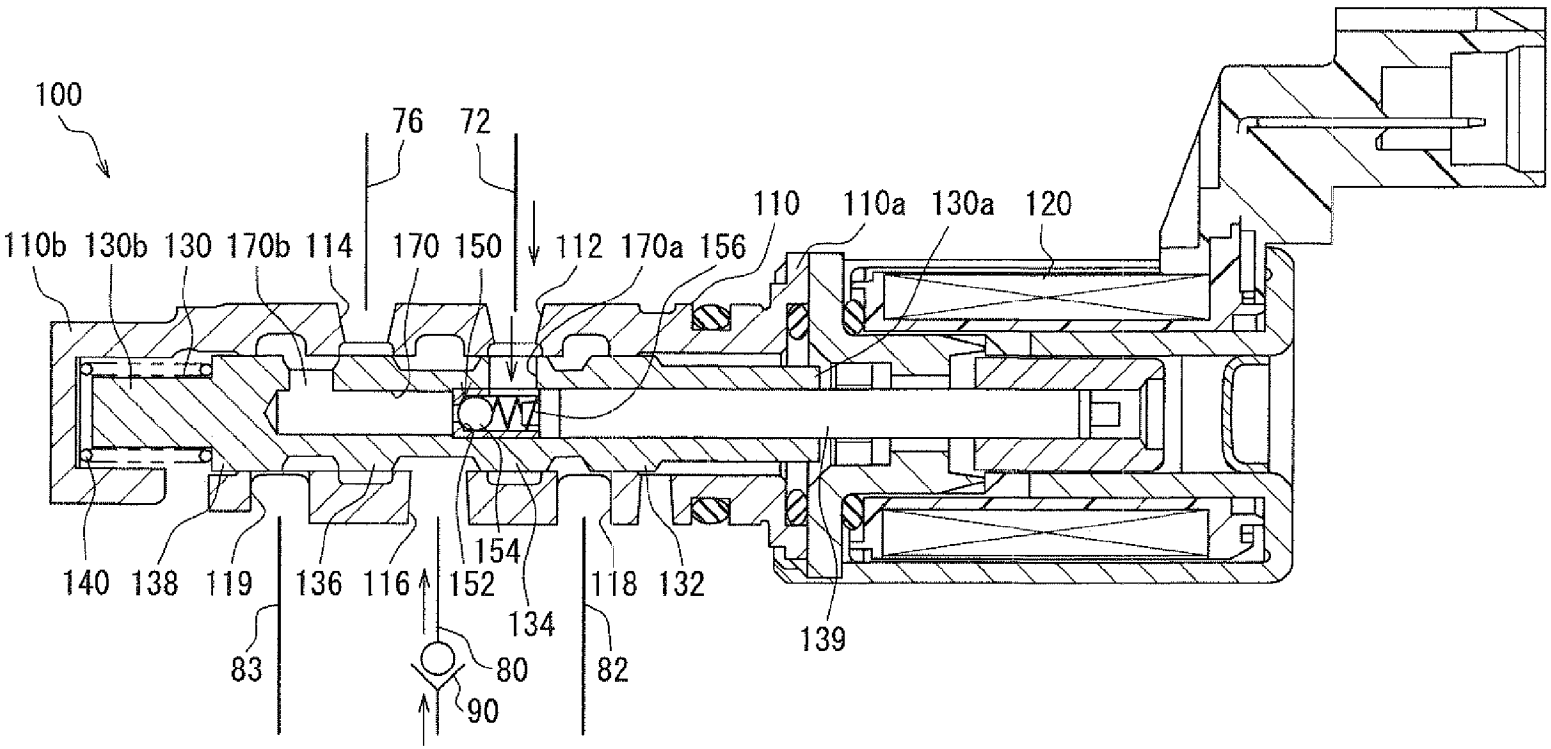
FIG. 5 is a cross-sectional view schematically showing still another operational state of the spool valve in FIG. 1.

The advance support land 132 is always slidably supported by a section of the sleeve 110, which is on a side of the drain port 118 toward the end 110*a*. The advance selection land 134 is slide-supported by at least one of other sections of the sleeve 110, which are on both axial sides of the advance port 112 toward the supply port 116 and toward the drain port 118. As shown in FIG. 4, when the advance selection land 134 is supported only by the section located on a side of the advance port 112 toward the supply port 116, the drain port 118 is connected to the advance port 112 through a gap between the advance selection land 134 and the advance support land 132. Further, as shown in FIG. 3, when the advance selection land 134 is supported only by the section located on a side of the advance port 112 toward the drain port 118, the supply port 116 is connected to the advance port 112 through a gap between the advance selection land 134 and the retard selection land 136. Further, as shown in FIG. 5, when the advance selection land 134 is supported on the sections located on both sides of the advance port 112 toward the supply port 116 and the drain port 118, the advance port 112 is disconnected from the other ports.

As shown in FIG. 3, the retard support land 138 is always slide-supported by a section of the sleeve 110 on a side of the drain port 119 toward the end 110*b*. The retard selection land 136 is slide-supported by at least one of other sections of with the sleeve 110, which are located on both axial sides of the retard port 114 toward the supply port 116 and toward the drain port 119. As shown in FIG. 3, when the retard selection land 136 is supported only by the section located on a side of the retard port 114 toward the supply port 116, the drain port 119 is connected to the retard port 114 through a gap between the retard selection land 136 and the retard support land 138. Further, as shown in FIG. 4, when the retard selection land 136 is supported only by the section located on a side of the retard port 114 toward the drain port 119, the support port 116 is connected to the retard port 114 through a gap between the retard selection land 136 and the advance selection land 134. Further, as shown in FIG. 5, when the retard selection land 136 is supported by the sections located on both sides of the retard port 114 toward the supply port 116 and toward the drain port 119, the retard port 114 is disconnected from the other ports.

The return spring 140 is a metal compression coil spring coaxially accommodated in the sleeve 110. The return spring 140 is provided between (a) the end 110*b* located on a side of the sleeve 110 opposite to the solenoid 120 and (b) the retard support land 138 of the spool 130 in the sleeve 110. The return spring 140 generates a restoring force to press the spool 130 toward the solenoid 120 in the axial direction by compression deformation. Further, the solenoid 120 generates an electromagnetic driving force to press the spool 130 toward the return spring 140 side in the axial direction by energization. Accordingly, in the spool valve 100, the spool 130 is driven in correspondence with the balance between the restoring force generated by the return spring 140 and the electromagnetic driving force generated by the solenoid 120.

In the above arrangement, when an energization current to the solenoid 120 is lower than a predetermined reference value $I_b$, the supply port 116 is connected to the advance port 112 and the drain port 119 is connected to the retard port 114 as shown in FIG. 3. Further, when the energization current to the solenoid 120 is higher than the reference value $I_b$, the drain port 118 is connected to the advance port 112 and the supply port 116 is connected to the retard port 114 as shown in FIG. 4. Further, when the energization current to the solenoid 120 is equal to the reference value $I_b$, the supply port 116 and the drain ports 118, 119 are disconnected from the advance port 112 and the retard port 114 as shown in FIG. 5.

The feature of the present embodiment is that, in this structure, a check valve 150 is provided in a connection passage 170 of the spool 130 as shown in FIG. 3.

More particularly, the connection passage 170 is formed in a portion of the spool 130, which extends from the advance selection land 134 to the retard support land 138. In the connection passage 170, one end 170*a* is opened in an outer peripheral surface of the advance selection land 134, and always faces with and communicates with the advance port 112 as shown in FIGS. 3 to 5. Further, the other end 170*b* of the connection passage 170 is opened at another outer peripheral surface of the spool 130, which is located between the retard selection land 136 and the retard support land 138 as shown in FIGS. 3 to 5. In the above, the retard selection land 136 and the retard support land 138 are located on both sides of a gap that always communicates with the drain port 119.

The check valve 150 is provided in the connection passage 170 such that the check valve 150 is opened to allow hydraulic oil to flow in a direction from the one end 170*a* toward the other end 170*b*. Note that the check valve 150 in the present embodiment includes a valve seat 152, a valve body 154 and a pressing member 156.

The valve seat 152 is a part of an inner peripheral wall surface of the connection passage 170, which has a diameter reduced toward the end 170*b* to have a conical surface. The metal valve body 154 having a ball shape is provided on the end 170*a* side of the valve seat 152 in the connection passage 170. The valve body 154 is seated on and disengaged from the valve seat 152 in the axial direction. The pressing member 156 is made of a metal compression coil spring and is provided in the connection passage 170 between (a) the valve body 154 and (b) an inner wall surface 158, which axially faces the valve seat 152. The pressing member 156 generates a restoring force to press the valve body 154 toward the valve seat 152 by compression deformation.

Figure 6:
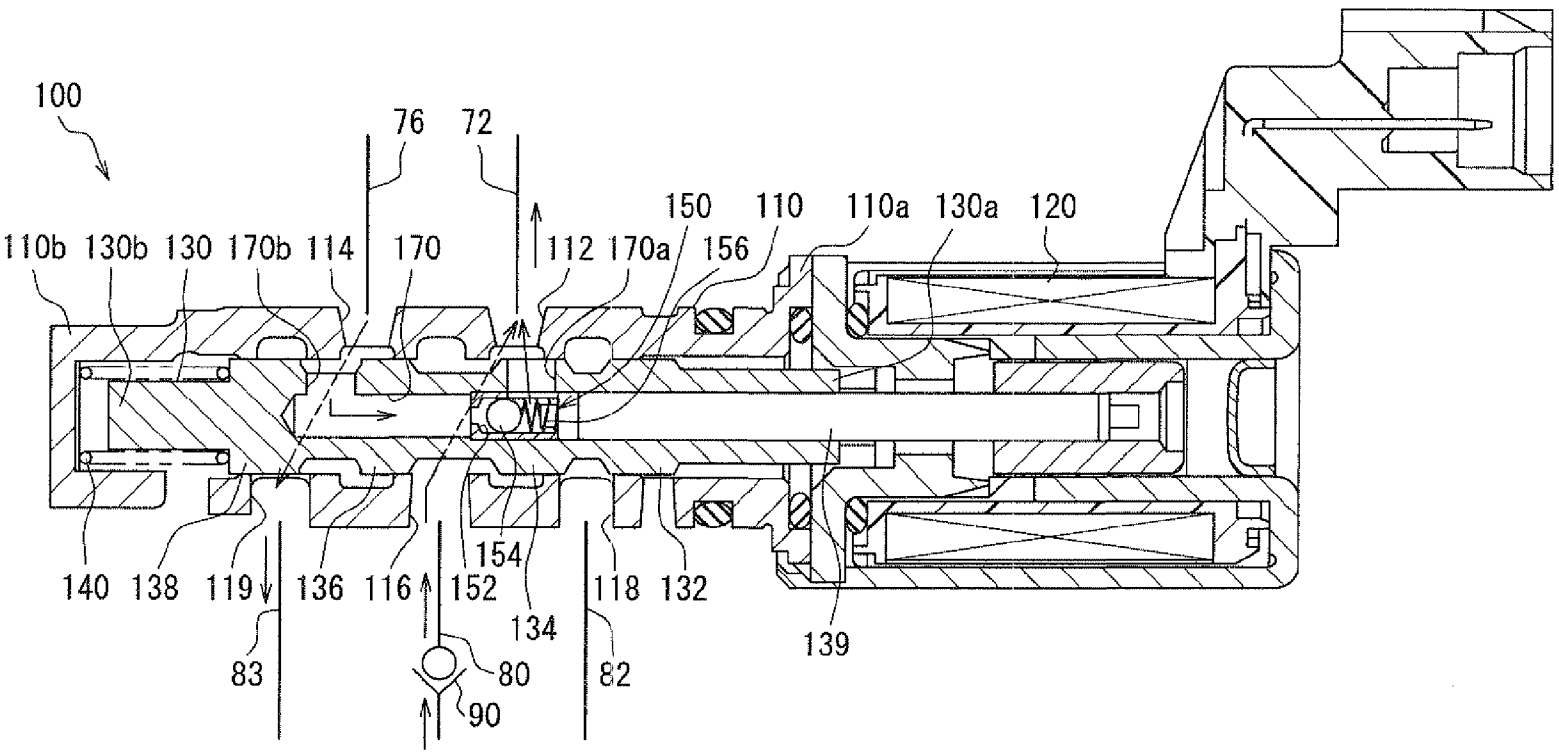
FIG. 6 is a cross-sectional view schematically showing still another operational state of the spool valve in FIG. 1.

In the above structure, the check valve 150 is closed to limit hydraulic oil from flowing in a direction from the one end 170*a* toward the other end 170*b* in the connection passage 170 as shown in FIG. 3. On the other hand, the check valve 150 is opened to allow hydraulic oil to flow in an opposite direction opposite to the above as shown in FIG. 6.

(Valve Timing Control Operation)

In the first embodiment, during running of the internal combustion engine in which the pump 4 is driven, the control circuit 180 calculates an actual phase and a target phase for the engine phase of the camshaft 2 with respect to the crankshaft, and controls the energization current to the solenoid 120 of the spool valve 100 in correspondence with the result of calculation. In accordance with the control, the spool 130 of the spool valve 100 is moved, and hydraulic oil is supplied to and discharged from the advance chambers 52 to 54 and the retard chambers 56 to 58 in accordance with the position of the spool 130, and thereby the valve timing is controlled.

Hereinbelow, the valve timing control operation by the valve timing control apparatus 1 according to the present embodiment will be described in detail.

(1) Advance Operation

Hereinbelow, an operation to change the engine phase of the camshaft 2 in the advance direction with respect to the crankshaft so as to advance the valve timing will be described.

In the internal combustion engine, when a running condition to indicate a low/medium-speed and heavy-load state requiring a vehicle accelerator OFF state or output torque is established, the control circuit 180 controls the energization current to the solenoid 120 to a value lower than the reference value $I_b$. As a result, the spool 130 is moved to be located on the advance position shown in FIGS. 3, 6 such that the supply port 116 is connected to the advance port 112 and the drain port 119 is connected to the retard port 114. When the spool 130 is located on the advance position, the connection passage 170 of the spool 130 has the one end 170*a* that faces the advance port 112 such that the connection passage 170 is connected to the supply port 116. Also, in the above position, the other end 170*b* of the connection passage 170 faces the retard port 114 such that the connection passage 170 is connected to the drain port 119. That is, the connection passage 170 connects the supply passage 80, which communicates with the supply port 116, to the drain passage 83, which communicates with the drain port 119.

Accordingly, when the variable torque (negative torque) acts on the vane rotor 14 in the negative direction, hydraulic oil supplied from the pump 4 to the supply passage 80 is supplied to the advance chambers 52 to 54 through the supply port 116 and the advance port 112 as shown in FIG. 6. Further, hydraulic oil in the retard chambers 56 to 58 is compressed with the vane rotor 14 actuated by the negative torque, and the above hydraulic oil flows through the retard port 114 into the drain pod 119. Thus, hydraulic oil in the retard chambers 56 to 58 is discharged through the drain passage 83 to the oil pan 5. The hydraulic oil also flows into the connection passage 170 through a passage between the ports 119, 114 or through the other end 170*b* of the connection passage 170, for example. At this time, the check valve 150 is opened against the pressure of the supplied hydraulic oil in the supply port 116 so as to allow a flow of hydraulic oil toward the ports 116, 112. Thus hydraulic oil, which has flowed into the connection passage 170, is supplied through the advance port 112 to the advance chambers 52 to 54. When negative torque is applied, volumes of the advance chambers 52 to 54 may be increased accordingly. However, the shortage of hydraulic oil supplied to the thus expanded advance chambers 52 to 54 is limited even in a case, where the amount of hydraulic oil supply is relatively reduced, because compensation for the above reduced amount of supply is made with hydraulic oil supplied from the ports 119, 114.

On the other hand, when the variable torque (positive torque) acts on the vane rotor 14 in the positive direction and the advance chambers 52 to 54 are compressed with the vane rotor 14, hydraulic oil is to flow backward from the advance port 112 to the connection passage 170 and the supply passage 80 as shown in FIG. 3. However, at this time, a flow of hydraulic oil in the connection passage 170 toward the ports 119, 114 is regulated with the check valve 150, and a flow of hydraulic oil in the supply passage 80 toward the pump 4 is regulated with the check valve 90. Accordingly, hydraulic oil is limited from flowing out of the advance chambers 52 to 54, and further, erroneous supply of hydraulic oil to the retard chambers 56 to 58 is avoided.

As described above, it is possible to supply a sufficient amount of hydraulic oil to the advance chambers 52 to 54 and also to discharge hydraulic oil from the retard chambers 56 to 58. Even when the average torque of the variable torque is biased in the retard direction, advance response is reliably improved.

(2) Retard Operation

Hereinbelow, an operation to change the engine phase of the camshaft 2 in the retard direction with respect to the crankshaft so as to retard the valve timing will be described.

Figure 7:
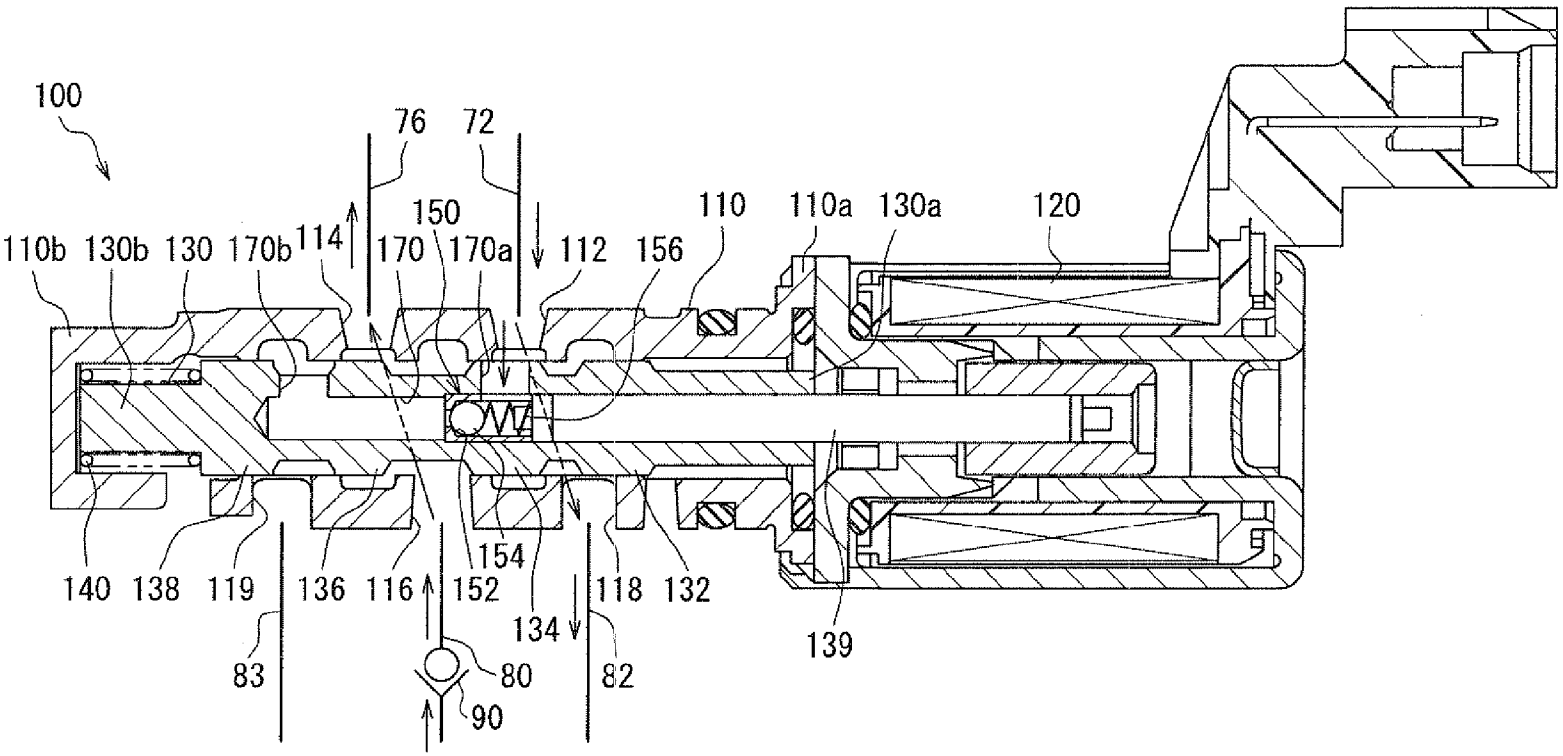
FIG. 7 is a cross-sectional view schematically showing still another operational state of the spool valve in FIG. 1.

In the internal combustion engine, when a running condition to indicate a light-load normal running state is established, the control circuit 180 controls the energization current to the solenoid 120 to a value higher than the reference value $I_b$. As a result, the spool 130 is moved to the retard position as shown in FIGS. 4, 7 such that the supply port 116 is connected to the retard port 114 and the drain port 118 is connected to the advance port 112. When the connection passage 170 of the spool 130 is located in the retard position, the one end 170*a* of the connection passage 170 faces the advance port 112 and is connected to the drain port 118. However, the other end 170*b* of the connection passage 170 does not face the retard port 114. Thus, the supply port 116, which communicates with the supply passage 80, is disconnected from the drain port 118, which communicates with the drain passage 82.

Accordingly, when the positive torque acts on the vane rotor 14, hydraulic oil supplied from the pump 4 to the supply passage 80 is supplied through the supply port 116 and the retard port 114 to the retard chambers 56 to 58 as shown in FIG. 7. Further, hydraulic oil in the advance chambers 52 to 54 is compressed with the vane rotor 14 actuated by the positive torque, and hydraulic oil in the advance chambers 52 to 54 flows through the advance port 112 into the drain port 118. As a result, the above hydraulic oil is discharged through the drain passage 82 to the oil pan 5. The check valve 150 regulates a flow of hydraulic oil toward the drain port 119 at a side of the connection passage 170, which faces the advance port 112.

On the other hand, when the negative torque acts on the vane rotor 14 and the retard chambers 56 to 58 are compressed with the vane rotor 14, hydraulic oil is to flow backward from the retard port 114 to the supply passage 80 as shown in FIG. 4. However, in the supply passage 80, the check valve 90 limits hydraulic oil from flowing in a direction toward the pump 4. As a result, it is possible to limit hydraulic oil from flowing out of the retard chambers 56 to 58, and thereby retard response is reliably improved.

(3) Holding Operation

Hereinbelow, an operation to hold the engine phase in a predetermined target phase area or angular range so as to substantially hold the valve timing will be described.

When a running condition to indicate a stable running state of the internal combustion engine, such as a state for holding an accelerator pedal of a vehicle, is established, the control circuit 180 controls the energization current to the solenoid 120 to the reference value $I_b$. As a result, the spool 130 is moved to a hold position as shown in FIG. 5 such that the supply port 116 and the drain ports 118, 119 are disconnected from the advance port 112 and the retard port 114. When the spool 130 is located in the hold position, the one end 170*a* of the connection passage 170 faces the advance port 112, while the other end 170*b* of the connection passage 170 does not face the retard port 114. Accordingly, the supply port 116, which communicates with the supply passage 80, is disconnected from the drain ports 118, 119, which communicate with the drain passages 82, 83.

Accordingly, hydraulic oil supplied from the pump 4 to the supply passage 80 is not supplied to any of the advance chambers 52 to 54 and the retard chambers 56 to 58 by disconnection of the supply 116 from the advance and retard ports 112, 114. Further, in addition to the disconnection of the drain ports 118, 119 from the advance and retard ports 112, 114, even when hydraulic oil in the advance chambers 52 to 54 is compressed by the action of the positive torque as shown in FIG. 5 and is to flow backward from the advance port 112 to the connection passage 170, the check valve 150 regulates a flow of hydraulic oil toward the drain port 119. Thus outflow of hydraulic oil from the advance chambers 52 to 54 and the retard chambers 56 to 58 is limited. In this arrangement, it is possible to suppress changes of the engine phase, and thereby substantially hold the valve timing.

In the present embodiment, the connection passage is provided in the spool 130 and thereby is positioned substantially close to the retard chamber and the advance chamber. As a result, working fluid or hydraulic oil, which is discharged from the retard chamber or the advance chamber to the corresponding drain passage, flows through the connection passage toward the supply passage 80. Therefore, the pressure of hydraulic oil is limited from being reduced before hydraulic oil arrives the supply passage 80. Accordingly, when the amount of hydraulic oil supplied from the fluid supply source 4 to the supply passage 80 is small, it is possible to quickly feed a sufficient amount of hydraulic oil through the drain passage to the supply passage 80, and thereby to limit degradation of the response.

According to the first embodiment as described above, it is possible to quickly and precisely control valve timing appropriately to an operational state of the internal combustion engine. Note that in the above-described first embodiment, the housing 12 corresponds to a "first rotor"; the vane rotor 14 corresponds to a "second rotor"; the controller 30 corresponds to a "controller"; the pump 4 corresponds to a "fluid supply source"; the check valve 150 corresponds to a "main check valve"; and the check valve 90 corresponds to a "sub check valve".

Second Embodiment

Figure 8:
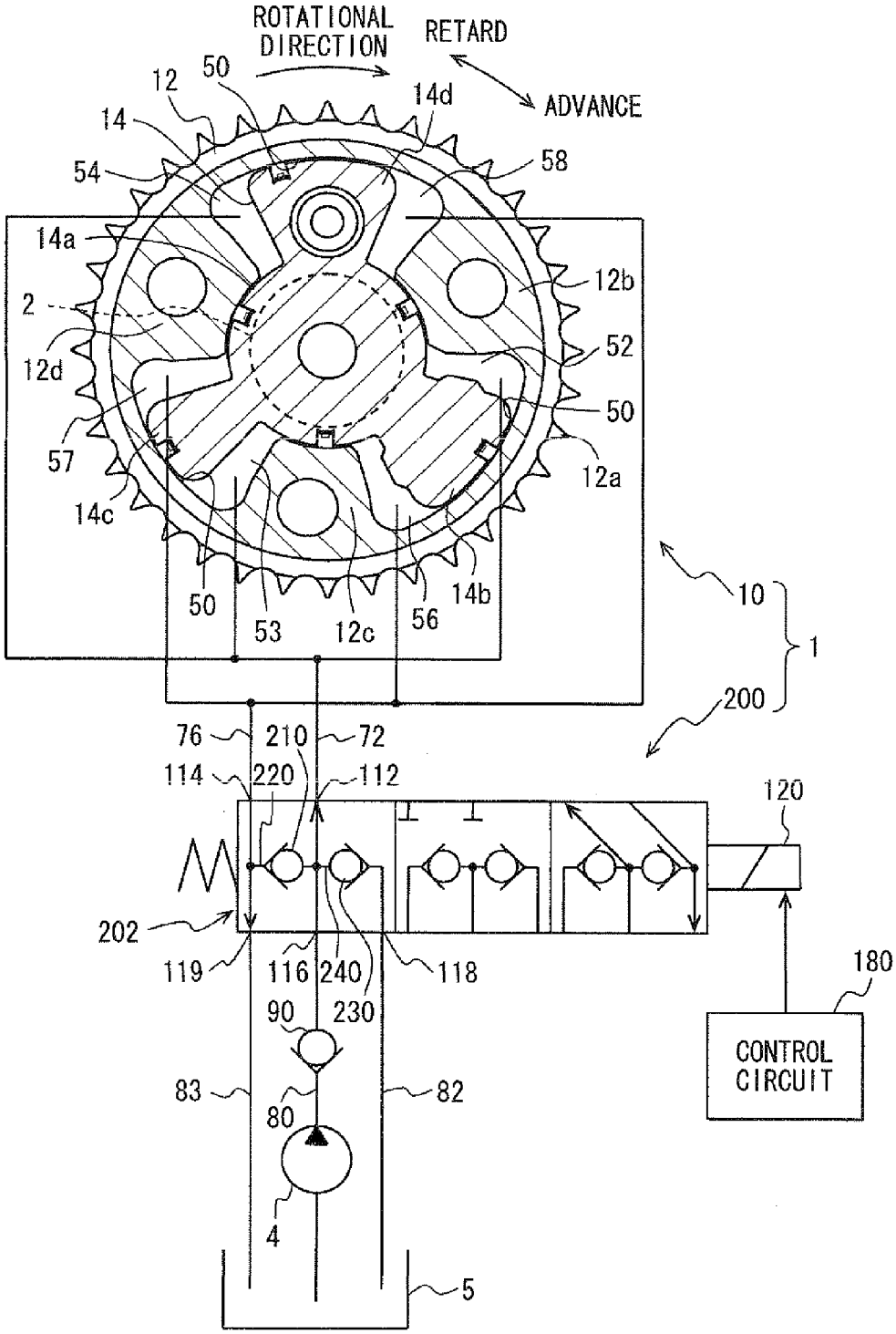
FIG. 8 is a block diagram showing the valve timing control apparatus according to a second embodiment of the present invention.
Figure 9:
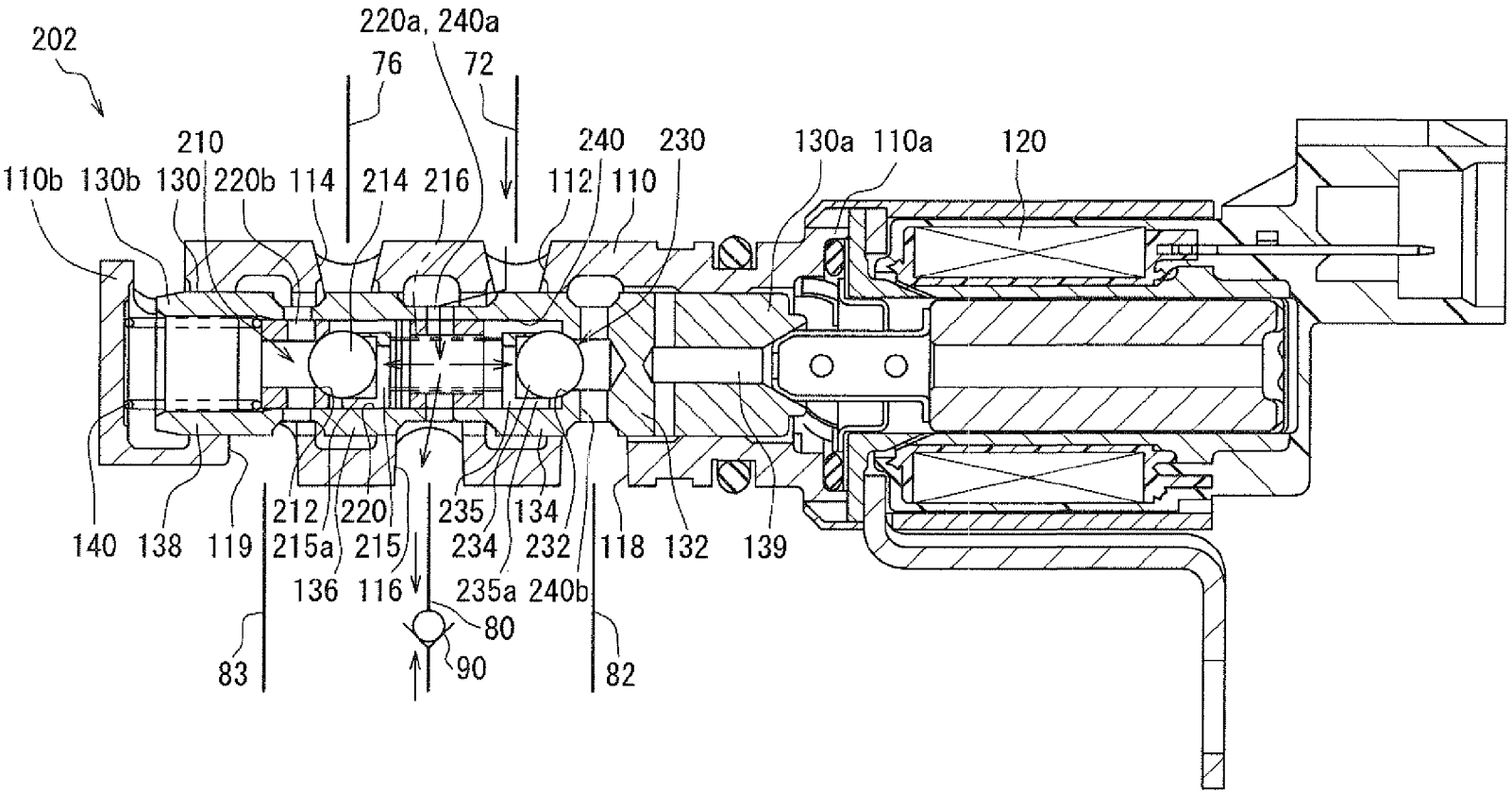
FIG. 9 is a cross-sectional view schematically showing the detailed structure and an operational state of the spool valve in FIG. 8.

The second embodiment of the present invention is a modification of the first embodiment. As shown in FIGS. 8, 9, in a spool valve 202 in a controller 200 according to the second embodiment, a first check valve 210 is provided in a first connection passage 220, and a second check valve 230 is provided in the second connection passage 240.

Figure 10:
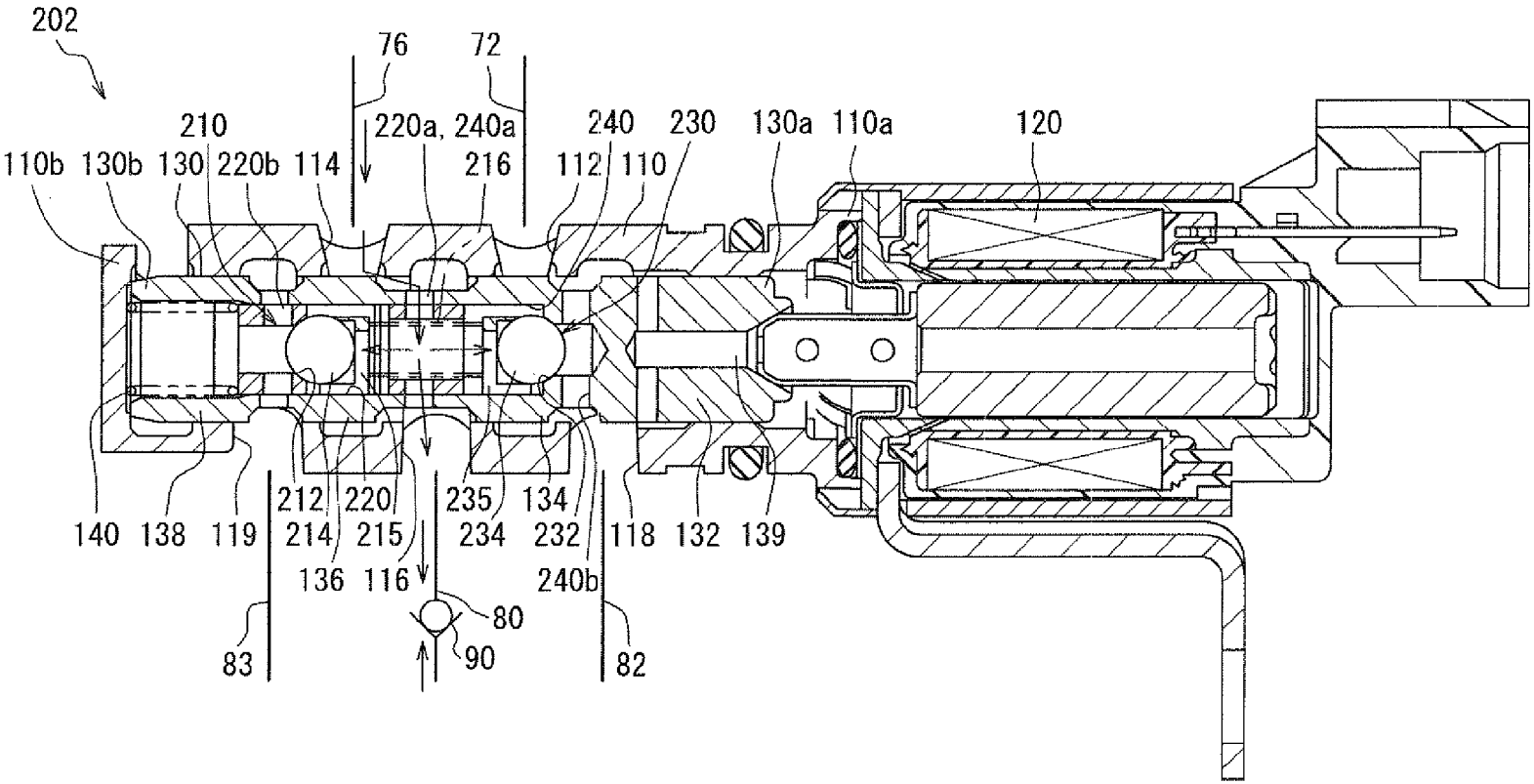
FIG. 10 is a cross-sectional view schematically showing another operational state of the spool valve in FIG. 8.
Figure 11:
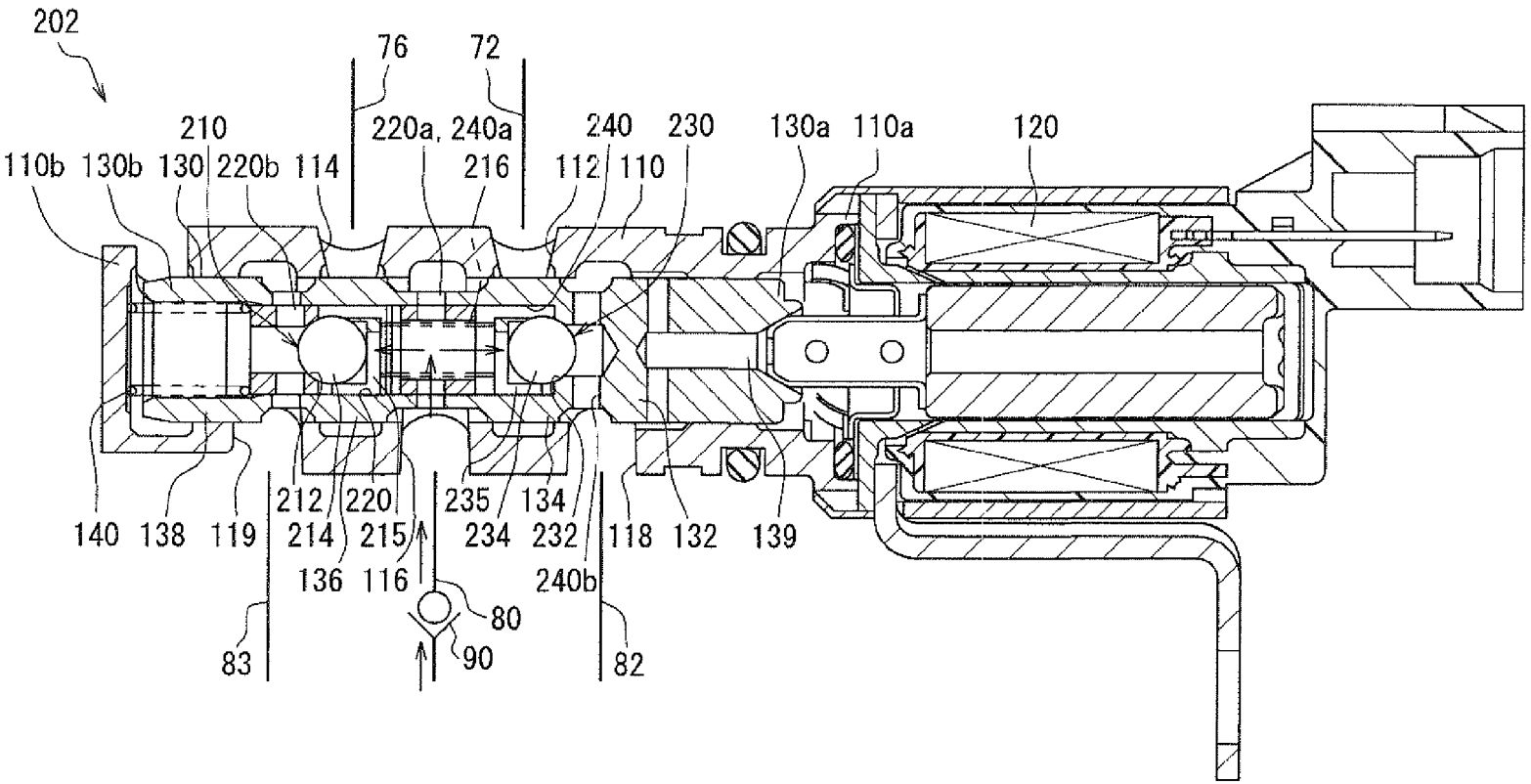
FIG. 11 is a cross-sectional view schematically showing still another operational state of the spool valve in FIG. 8.

More particularly, as shown in FIGS. 9 to 11 the first connection passage 220 is formed in the spool 130 of the spool valve 202, and the first connection passage 220 has one ends 220*a* that are opened at multiple positions in the outer peripheral surface of the spool 130, which are located between the advance selection land 134 and the retard selection land 136. In the above, the advance selection land 134 and the retard selection land 136 are located on both axial sides of a gap that always communicates with the supply port 116. Further, the other ends 220*b* of the first connection passage 220 are opened in other multiple positions in the outer peripheral surface of the spool 130, which are located between the retard selection land 136 and the retard support land 138. In the above, the retard selection land 136 and the retard support land 138 are located on both axial sides of a gap that always communicates with the drain port 119.

The first check valve 210 is provided in the first connection passage 220 having the above structure such that the first check valve 210 limits hydraulic oil from flowing in a direction (valve-closed direction) from the one end 220*a* toward the other end 220*b*. The first check valve 210 in the present embodiment includes a valve seat 212, a valve body 214, a retainer 215 and a pressing member 216.

As shown in FIG. 9, the valve seat 212 is a part of an inner peripheral wall surface of the first connection passage 220, which has a diameter reduced toward the end 220*b* to have a conical surface. The metal valve body 214 having a ball shape is provided on a side of the valve seat 212 toward the end 220*a* in the first connection passage 220. The valve body 214 is seated on and disengaged from the valve seat 212 in the axial direction. The retainer 215 is made of a metal and has a cylindrical shape with a bottom. The retainer 215 is provided in the first connection passage 220 on an side of the valve body 214 opposite to the valve seat 212. In the retainer 215, a peripheral wall 215*a* has an outer peripheral surface that is reciprocably and slidably supported by the inner peripheral wall surface of the first connection passage 220 in the axial direction. Also, the peripheral wall 215*a* has an inner peripheral surface that holds the valve body 214. The pressing member 216 is made of a metal compression coil spring, and is provided in the first connection passage 220 on a side of the retainer 215 opposite to the valve body 214. The pressing member 216 is provided between (a) the retainer 215 and (b) the second check valve 230 that is provided oppositely to the valve seat 212 in the axial direction. The pressing member 216 generates a restoring force to press the valve body 214 to the valve seat 212 via the retainer 215 by compression deformation.

Figure 12:
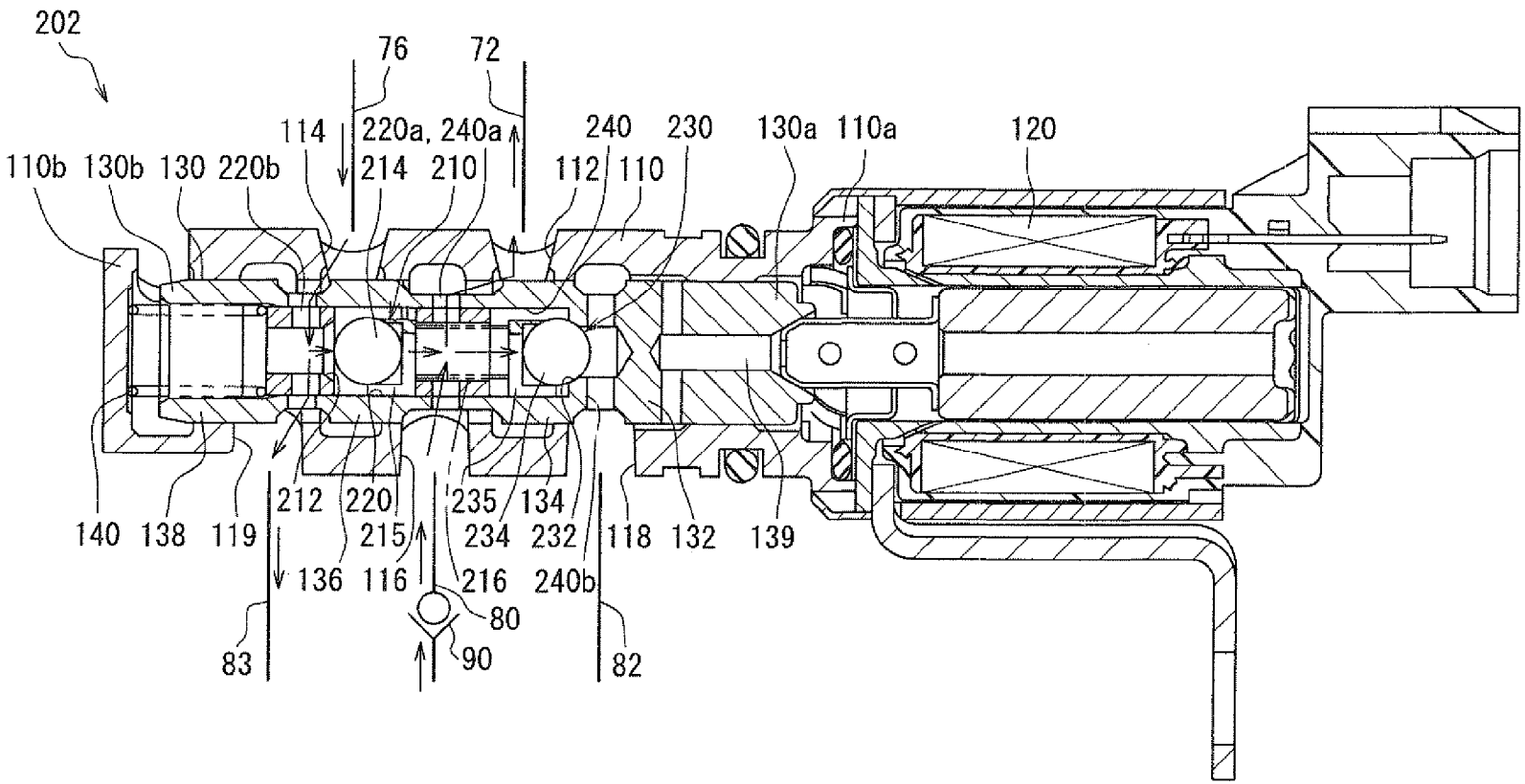
FIG. 12 is a cross-sectional view schematically showing still another operational state of the spool valve in FIG. 8.

In this structure, the first check valve 210 is closed as shown in FIG. 9 to regulate a flow of hydraulic oil in a direction from the one end 220*a* toward the other end 220*b* in the first connection passage 220, while the first check valve 210 is opened as shown in FIG. 12 to allow a flow of hydraulic oil in the opposite direction opposite to the above regulated direction.

On the other hand, as shown in FIG. 9, one ends 240*a* of the second connection passage 240 are formed in the spool 130 and serve also as the one ends 220*a* of the first connection passage 220. Further, as shown in FIGS. 9 to 11, the other end 240*b* of the second passage 240 are opened between the advance selection land 134 and the advance support land 132 at multiple positions in the outer peripheral surface of the spool 130. In the above, the advance selection land 134 and the advance support land 132 are located on both axial sides of a gap that always communicates with the drain port 118.

The second check valve 230 is provided in the second communication passage 240 having the above structure such that the second check valve 230 limits hydraulic oil from flowing in a direction (valve-closed direction) from the one end 240*a* toward the other end 240*b*. The second check valve 230 in the present embodiment has the same structure as that of the first check valve 210, and in other words, the second check valve 230 includes a valve seat 232, a valve body 234, a retainer 235 and a pressing member 216.

Note that as shown in FIG. 9, in the second check valve 230, the valve seat 232 is a part of a inner peripheral wall surface of the second connection passage 240, which has a diameter reduced toward the end 240*b* to have a conical surface. The valve body 234 is provided in the second connection passage 240 on a side of the valve seat 232 toward the end 240*a*. The valve body 234 is seated on and disengaged from the valve seat 232 in the axial direction. The retainer 235 is provided in the second connection passage 240 on a side of the valve body 234 opposite to the valve seat 232. The retainer 235 has a peripheral wall 235*a* that has an outer peripheral surface held by an inner peripheral surface of the second connection passage 240. Also, the peripheral wall 235*a* of the retainer 235 has an inner peripheral surface that holds the valve body 234. The pressing member 216 that is used for the first check valve 210 is also used for the second check valve 230. The pressing member 216 is provided in the second connection passage 240 on a side of the retainer 235 opposite to the valve body 234. Thus, the pressing member 216 is provided between the retainers 235, 215. The pressing member 216 also generates a restoring force to press the valve body 234 toward the valve seat 232 via the retainer 235 by compression deformation.

Figure 13:
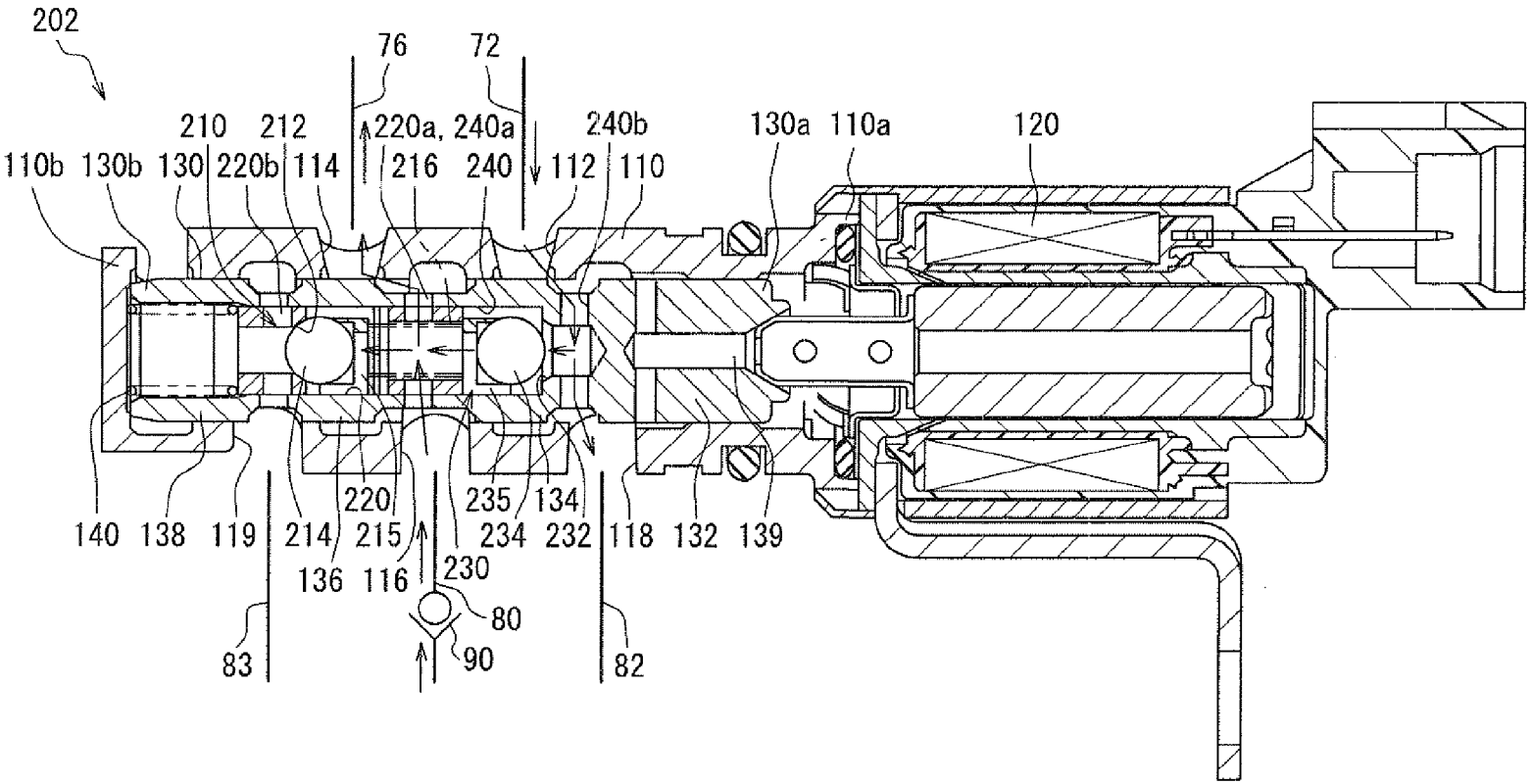
FIG. 13 is a cross-sectional view schematically showing still another operational state of the spool valve in FIG. 8.

In the above structure, the second check valve 230 is closed as shown in FIG. 10 to regulate a flow of hydraulic oil in a direction (valve-closed direction) from the one end 240*a* toward the other end 240*b* in the second connection passage 240. Also, the second check valve 230 is opened as shown in FIG. 13 to allow a flow of hydraulic oil in the direction opposite to the above valve-closed direction.

Hereinbelow, the valve timing control operations according to the second embodiment will be described in detail.

(1) Advance Operation

When the spool 130 is in the advance position as shown in FIGS. 9, 12 such that the supply port 116 and the drain port 119 are connected to the advance port 112 and the retard port 114, the one ends 220*a* and 240*a* of the connection passages 220, 240 are connected to the support port 116, and the other ends 220*b* and 240*b* of the connection passages 220, 240 are connected to the drain ports 119, 118. In this arrangement, the first connection passage 220 connects the supply passage 80, which communicates with the supply port 116, to the drain passage 83, which communicates with the drain port 119. On the other hand, the second connection passage 240 connects the supply passage 80 to the drain passage 82, which communicates with the drain port 118.

Accordingly, when the negative torque acts on the vane rotor 14, hydraulic oil supplied from the pump 4 is supplied through the supply port 116 and the advance port 112 to the advance chambers 52 to 54 as shown in FIG. 12. The hydraulic oil also flows into the second connection passage 240 from a passage between the ports 116, 112. However, at this time, as the second check valve 230 regulates a flow of hydraulic oil toward the drain port 118 connected to the second connection passage 240, discharge of a part of hydraulic oil supplied from the pump 4 to the oil pan 5 is avoided. Further, hydraulic oil in the retard chambers 56 to 58 is compressed with the vane rotor 14 actuated by the negative torque, and the above hydraulic oil in the retard chambers 56 to 58 flows through the retard port 114 into the drain port 119, and thereby is discharged to the oil pan 5. The hydraulic oil also flows into the first connection passage 220 between the ports 119, 114. At this time, as the first check valve 210 is opened against the pressure of the supplied hydraulic oil in the supply port 116, thereby allows a flow of hydraulic oil toward the supply port 116. Accordingly, hydraulic oil that has flowed in the first connection passage 220 is supplied through the advance port 112 to the advance chambers 52 to 54. When the amount of hydraulic oil supply is reduced, because hydraulic oil is replenished from the ports 119, 114, and thereby shortage of hydraulic oil in the advance chambers 52 to 54, the volume of each of which is expanded, is suppressed.

On the other hand, when the positive torque acts on the vane rotor 14 and the advance chambers 52 to 54 are compressed with the vane rotor 14, hydraulic oil is to flow backward from the advance port 112 to the connection passages 220, 240 and the supply passage 80 as shown in FIG. 9. However, at this time, in the respective connection passages 220, 240, flows of hydraulic oil toward the ports 119, 114, 118, 112 are regulated with the corresponding check valves 210, 230. Also, in the supply passage 80, a flow of hydraulic oil toward the pump 4 is regulated with the check valve 90. Accordingly, outflow of hydraulic oil that flows out of the advance chambers 52 to 54 is suppressed, and further, erroneous supply of hydraulic oil to the retard chambers 56 to 58 is avoided.

As described above, it is possible to supply a sufficient amount of hydraulic oil to the advance chambers 52 to 54 and also to discharge hydraulic oil from the retard chambers 56 to 58. As a result, the advance response is reliably improved.

(2) Retard Operation

When the spool 130 is in the retard position as shown in FIGS. 10, 13 such that the supply port 116 and the drain port 118 are connected to the retard port 114 and the advance port 112, the one ends 220*a* and 240*a* of the connection passages 220, 240 are connected to the supply port 116, and the other ends 220*b* and 240*b* of the connection passages 220, 240 are connected to the drain ports 119, 118. That is, the first connection passage 220 connects the supply passage 80 to the drain passage 83, and the second connection passage 240 connects the supply passage 80 to the drain passage 82.

Accordingly, when the positive torque acts on the vane rotor 14, hydraulic oil supplied form the pump 4 is supplied through the supply port 116 and the retard port 114 to the retard chambers 56 to 58 as shown in FIG. 13. The hydraulic oil also flows into the first connection passage 220 from a passage between the ports 116, 114. However, at this time, as the first check valve 210 regulates a flow of hydraulic oil toward the drain port 119 connected to the first connection passage 220, discharge of a part of hydraulic oil supplied from the pump 4 to the oil pan 5 is avoided. Further, hydraulic oil in the advance chambers 52 to 54 is compressed with the vane rotor 14 actuated by the positive torque, and hydraulic oil in the advance chambers 52 to 54 flows through the advance port 112 into the drain port 118, and thereby is discharged to the oil pan 5. The hydraulic oil also flows into the second connection passage 240 from a passage between the ports 118, 112. At this time, the second check valve 230 is opened against the pressure of hydraulic oil from the supply port 116, and thereby allows a flow of hydraulic oil toward the supply port side 116. The hydraulic oil that has flowed in the second connection passage 240 is supplied through the retard port 114 to the retard chambers 56 to 58. Accordingly, when the amount of hydraulic oil supply is reduced, because hydraulic oil is replenished from the ports 118, 112, shortage of hydraulic oil in the retard chambers 56 to 58, the volume of each of which is expanded by the action of the positive torque, is suppressed.

On the other hand, when the negative torque acts on the vane rotor 14 and the retard chambers 56 to 58 are compressed with the vane rotor 14, hydraulic oil is to flow backward from the retard port 114 to the connection passages 220, 240 and the supply passage 80 as shown in FIG. 10. However, at this time, in the respective connection passages 220, 240, flows of hydraulic oil toward the ports 119, 114, 118, 112 are regulated with the corresponding check valves 210, 230, and in the supply passage 80, a flow of hydraulic oil toward the pump 4 side is regulated with the check valve 90. Accordingly, outflow of hydraulic oil from the retard chambers 56 to 58 is suppressed, and further, erroneous supply of hydraulic oil to the advance chambers 52 to 54 is avoided.

As described above, it is possible to supply a sufficient amount of hydraulic oil to the retard chambers 56 to 58 and also to discharge hydraulic oil from the advance chambers 52 to 54. As a result, retard response is reliably improved.

(3) Holding Operation

When the spool 130 is in the hold position as shown in FIG. 11 such that the supply port 116 and the drain port 118 are disconnected from the advance port 112 and the retard port 114, the one ends 220*a* and 240*a* of the connection passages 220, 240 are connected to the supply port 116, and the other ends 220*b* and 240*b* of the connection passages 220, 240 are connected to the drain pots 119, 118. That is, the first connection passage 220 connects the supply passage 80 to the drain passage 83, and the second connection passage 240 connects the supply passage 80 to the drain passage 82. However, the connection passages 220, 240 are disconnected form the advance and retard ports 112, 114.

Accordingly, hydraulic oil supplied from the pump 4 to the supply passage 80 is not supplied to any of the advance chambers 52 to 54 and the retard chambers 56 to 58, and outflow of hydraulic oil from the advance chambers 52 to 54 and the retard chambers 56 to 58 is regulated. Accordingly, changes of the engine phase are suppressed, and thereby the valve timing can be substantially held. Note that at this time, hydraulic oil flows from the supply port 116 into the connection passages 220, 240, however, flows of hydraulic oil toward the ports 119, 114, 118, 112 are regulated with the corresponding check valves 210, 230.

According to the above-described second embodiment, it is possible to quickly and precisely control valve timing appropriately to an operational state of the internal combustion engine. Note that in the above-described second embodiment, the controller 200 corresponds to the "controller"; the drain passage 83 corresponds to a "first drain passage"; the drain passage 82 corresponds to a "second drain passage"; and the first check valve 210 and the second check valve 230 correspond to the "main check valve".

Third Embodiment

Figure 14:
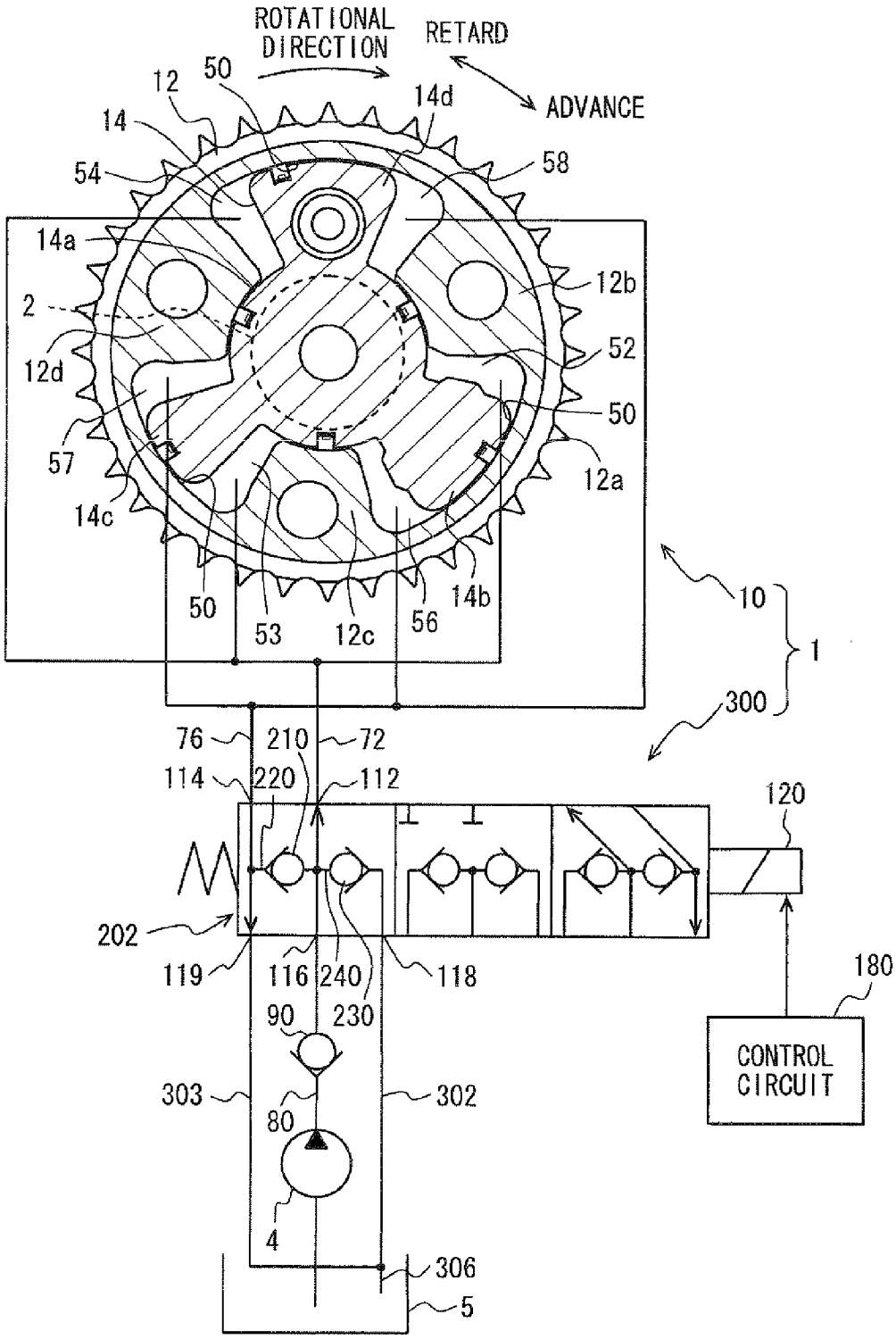
FIG. 14 is a block diagram showing the valve timing control apparatus according to a third embodiment of the present invention.
Figure 15:
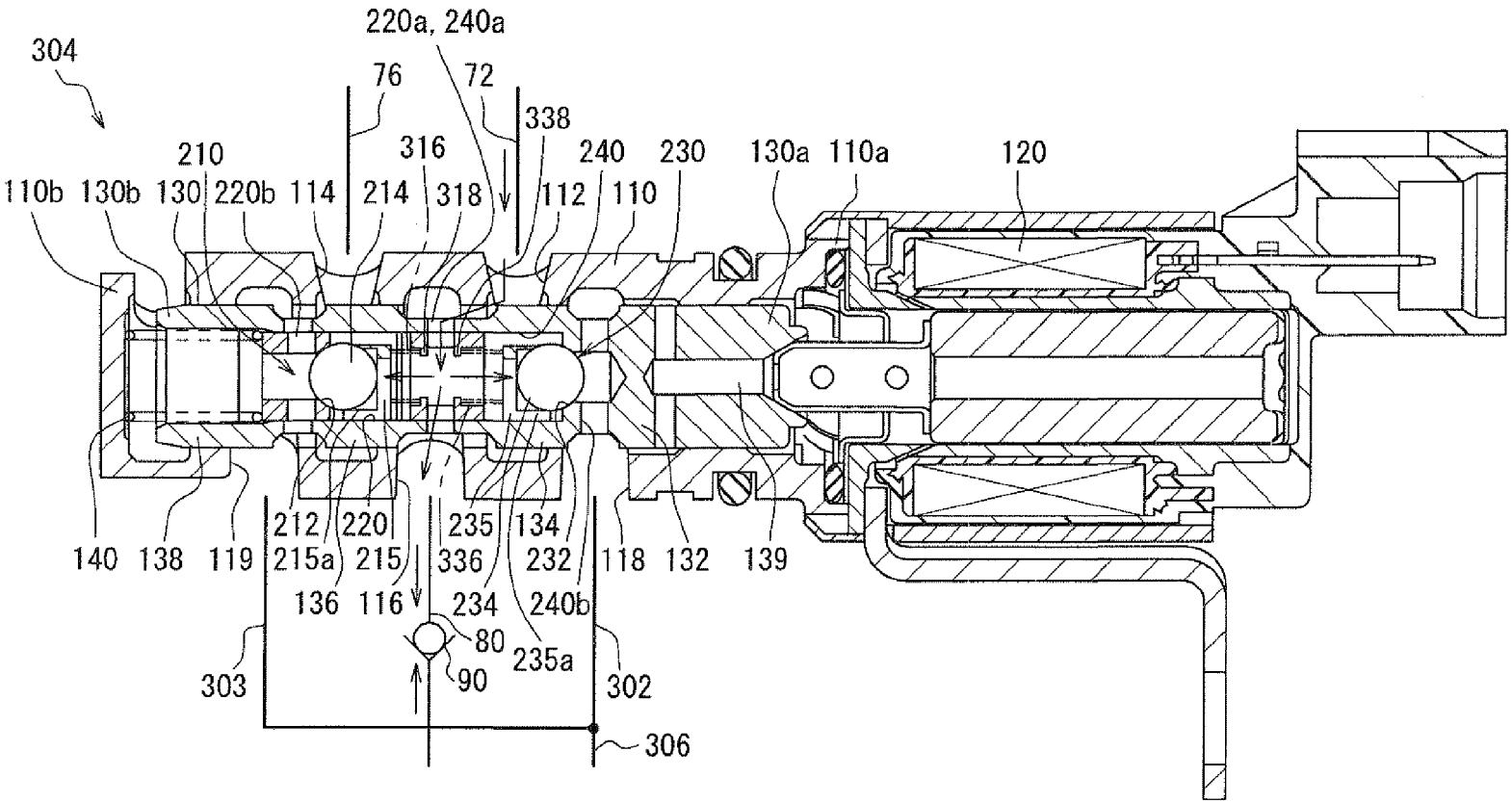
FIG. 15 is a cross-sectional view schematically showing the detailed structure and an operational state of the spool valve in FIG. 14.

The third embodiment of the present invention is a modification of the second embodiment. As shown in FIGS. 14, 15, in a controller 300 according to the third embodiment, drain passages 302, 303, which communicates with the drain ports 118, 119, communicate with each other, and hydraulic oil is discharged through a common passage 306 to the oil pan 5. In the above configuration, the common passage 306 is provided on a side of the drain passages 302, 303 opposite to a spool valve 304.

Further, as shown in FIG. 15, the check valves 210, 230 included in the spool 130 are provided with pressing members 316, 336. The pressing member 316 of the first check valve 210 is provided in the first connection passage 220 between (a) the retainer 215 and (b) an annular wall surface 318 that radially inwardly projects from the inner peripheral surface of the first connection passage 220 to face the valve seat 212. The pressing member 316 presses the valve body 214 to the valve seat 212 by compression deformation. Further, the pressing member 336 of the second check valve 230 is provided in the second connection passage 240 between (a) the retainer 235 and (b) an annular wall surface 338 that radially inwardly projects from the inner peripheral surface of the second connection passage 240 to face the valve seat 232. The pressing member 336 presses the valve body 234 to the valve seat 232 side by compression deformation.

Hereinbelow, among the valve timing control operations according to the third embodiment, the advance operation and the retard operation different from those in the second embodiment will be described.

Figure 16:
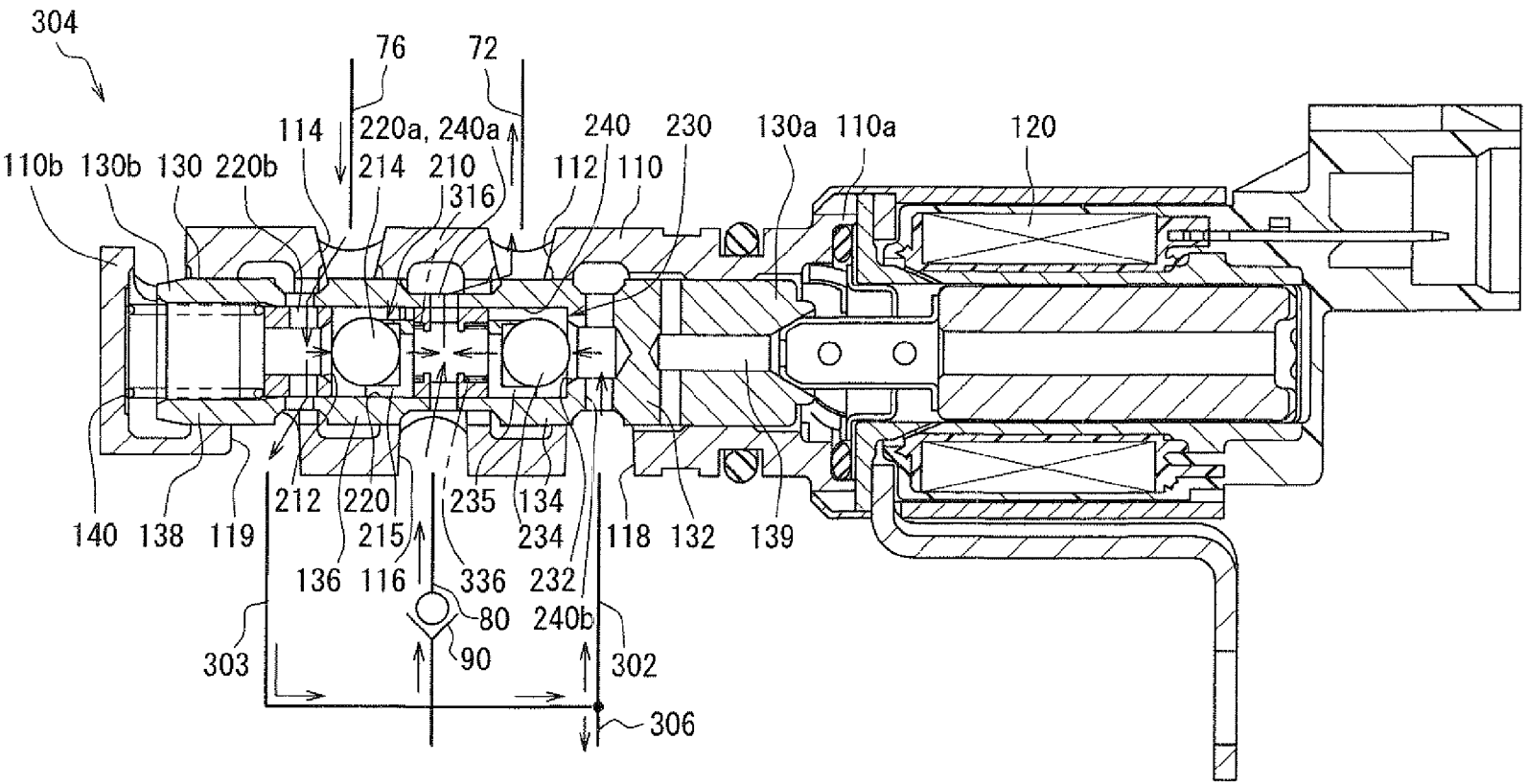
FIG. 16 is a cross-sectional view schematically showing another operational state of the spool valve in FIG. 14.

First, the advance operation will be described. As shown in FIG. 16, when the spool 130 is in the advance position and the negative torque acts on the vane rotor 14, hydraulic oil is compressed in the retard chambers 56 to 58 and flows through the retard port 114 into the drain port 119 and the drain passage 303 sequentially. A part of hydraulic oil flowing through the drain passage 303 is discharged to the oil pan 5, and the remaining hydraulic oil flows via the drain passage 302, which communicates with the drain passage 303, into the drain port 118 connected to the second connection passage 240. At this time, the second check valve 230 is opened against the pressure of the supplied hydraulic oil in the supply port 116, thereby allows a flow of hydraulic oil toward the supply port 116. Accordingly hydraulic oil, which flows through the drain port 118, is supplied through the advance port 112 to the advance chambers 52 to 54. When the amount of hydraulic oil supply is reduced, in addition to the compensation from the ports 119, 114 through the first check valve 210, hydraulic oil is replenished from the port 118, 112 through the second check valve 230. Accordingly, it is possible to supply hydraulic oil to the advance chambers 52 to 54, the volume of each of which is expanded, without shortage, thereby sufficiently improve the advance response.

Figure 17:
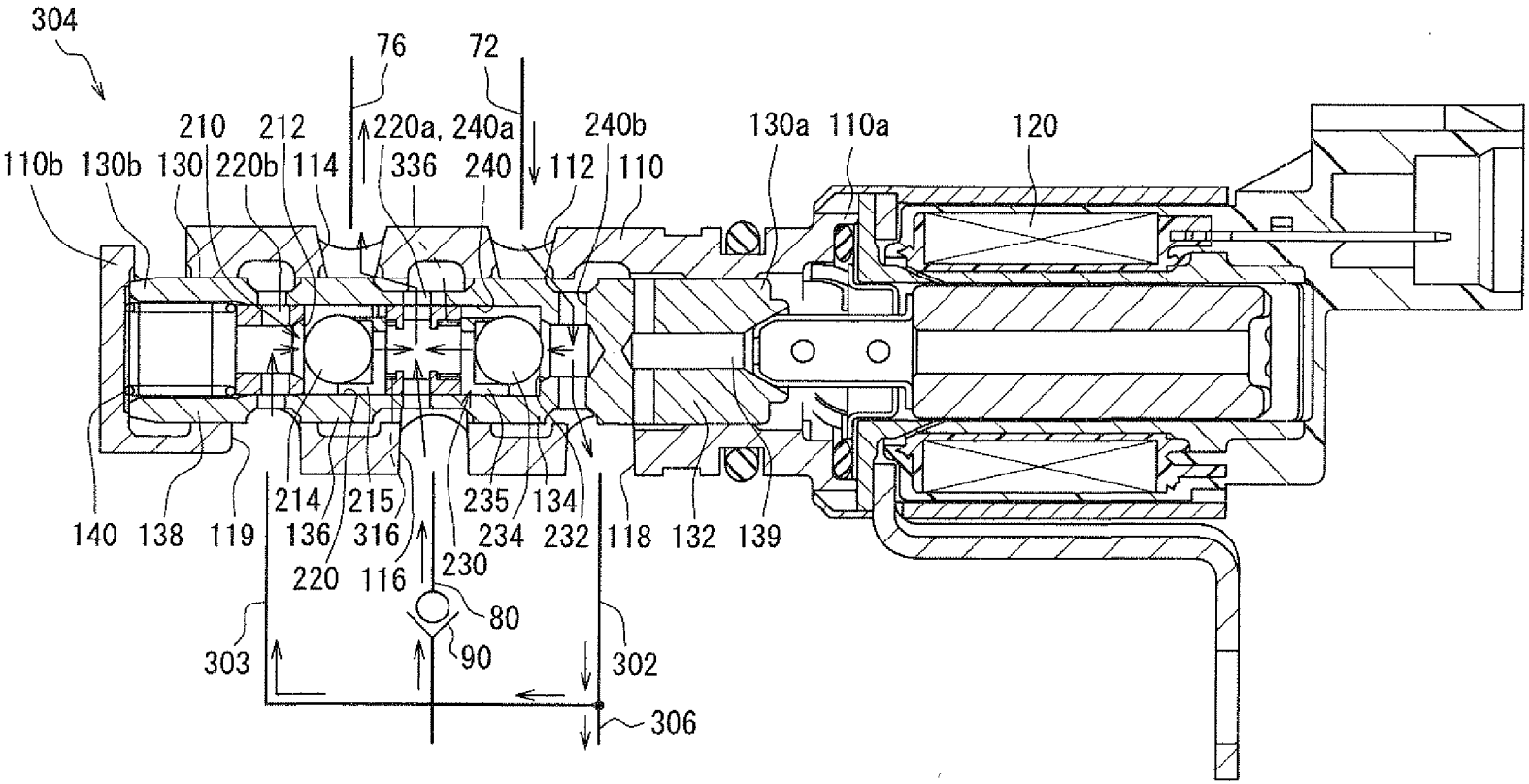
FIG. 17 is a cross-sectional view schematically showing still another operational state of the spool valve in FIG. 14.

Next, the retard operation will be described. As shown in FIG. 17, when the spool 130 is in the retard position and the positive torque acts on the vane rotor 14, hydraulic oil in the compressed advance chambers 52 to 54 flows from the advance port 112 into the drain port 118 and the drain passage 302 sequentially. A part of hydraulic oil flowing through the drain passage 302 is discharged to the oil pan 5, and the remaining hydraulic oil flows through the drain passage 303, which communicates with the drain passage 302, into the drain port 119 connected to the first connection passage 220. At this time, the first check valve 210 is opened against the pressure of the supplied hydraulic oil in the supply port 116, thereby allows a flow of hydraulic oil toward the supply port 116. Accordingly, hydraulic oil, which has flowed into the drain port 119, is supplied through the retard port 114 to the retard chambers 56 to 58. When the amount of hydraulic oil supply is reduced, in addition to the compensation from the ports 118, 112 via the second check valve 230, hydraulic oil is replenished from the ports 119, 114 via the first check valve 210. Accordingly, it is possible to supply hydraulic oil to the retard chambers 56 to 58, the volume of each of which is expanded, without shortage, thereby sufficiently improve the retard response.

According to the above-described third embodiment, it is possible to more quickly and more precisely control valve timing appropriately to an operational state of the internal combustion engine. Note that in the above-described third embodiment, the controller 300 corresponds to the "controller"; the drain passage 303 corresponds to the "first drain passage"; and the drain passage 302 corresponds to the "second drain passage".

Fourth Embodiment

Figure 18:
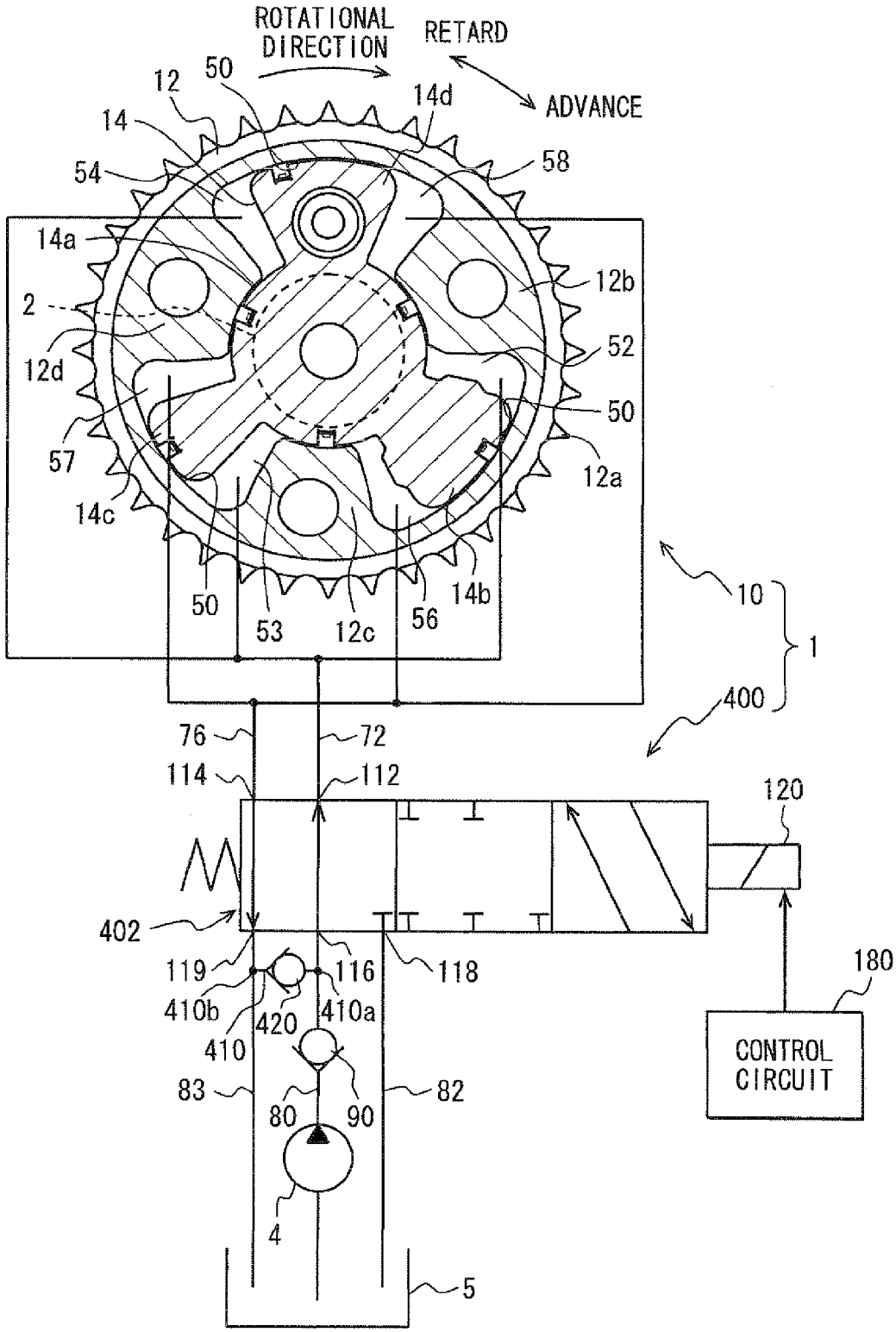
FIG. 18 is a block diagram showing the valve timing control apparatus according to a fourth embodiment of the present invention.
Figure 19:
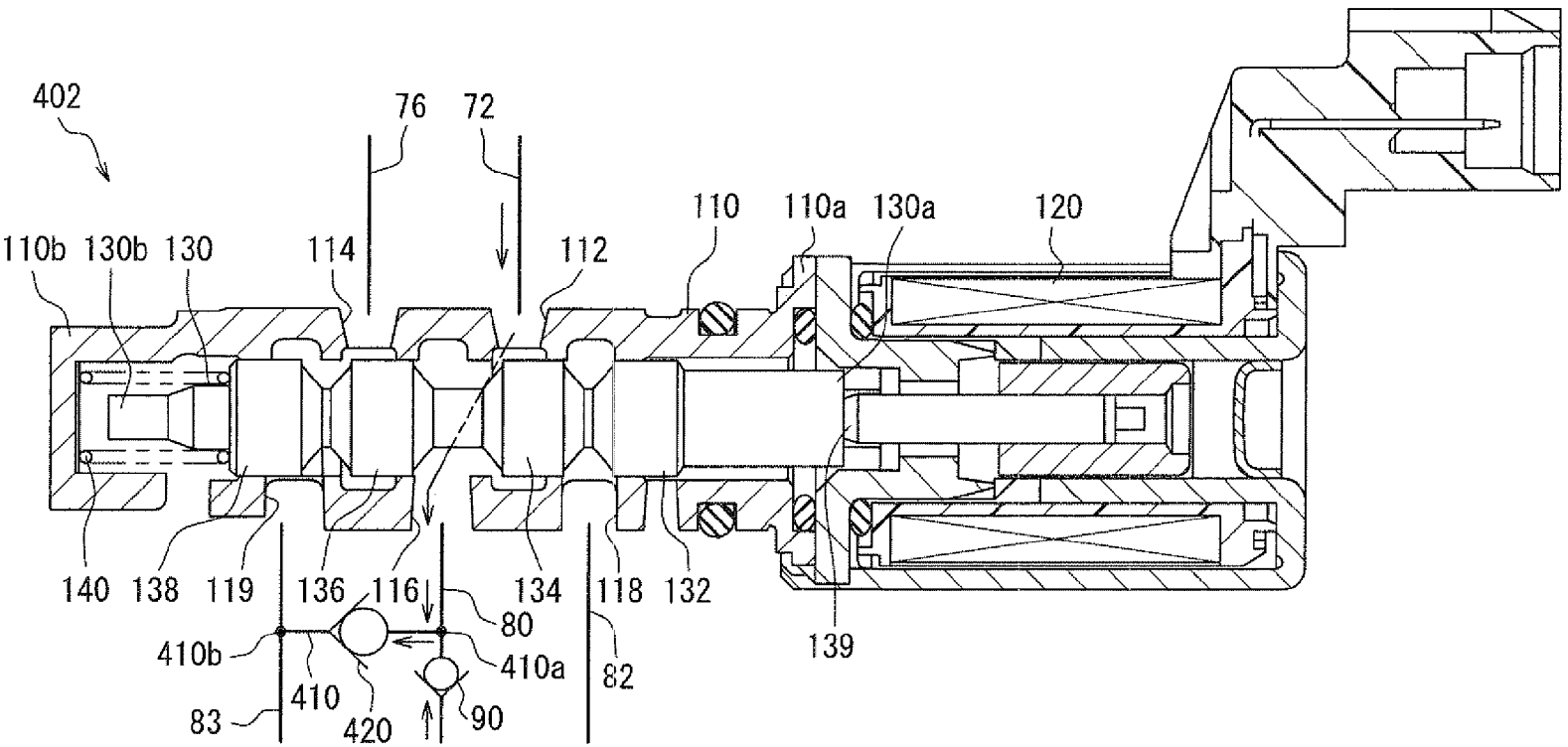
FIG. 19 is a cross-sectional view schematically showing the detailed structure and an operational state of the spool valve in FIG. 18.

The fourth embodiment of the present invention is a modification of the first embodiment. As shown in FIGS. 18, 19, in a controller 400 according to the fourth embodiment, a check valve 420 is provided in a connection passage 410 formed outside the spool valve 402.

Figure 20:
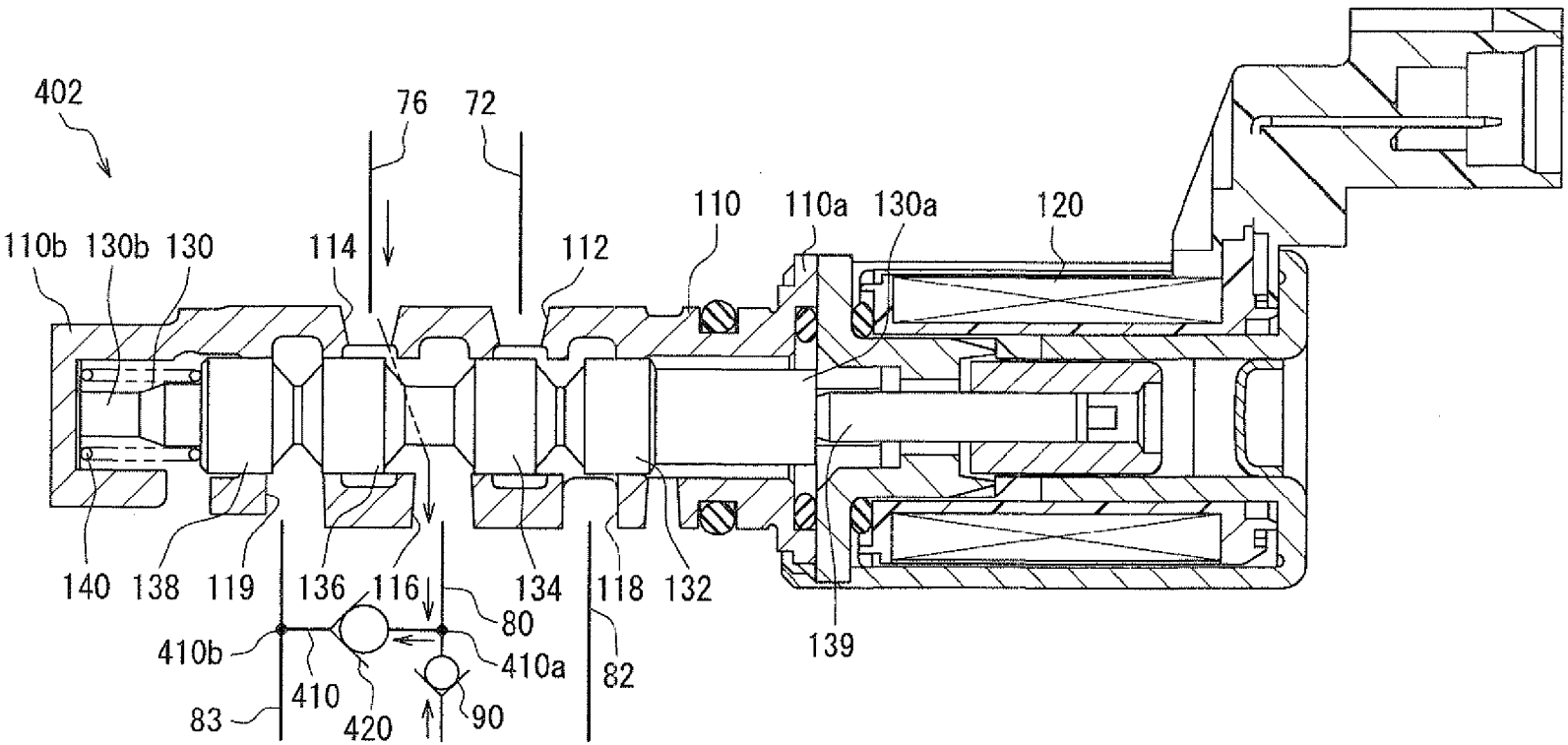
FIG. 20 is a cross-sectional view schematically showing another operational state of the spool valve in FIG. 18.
Figure 21:
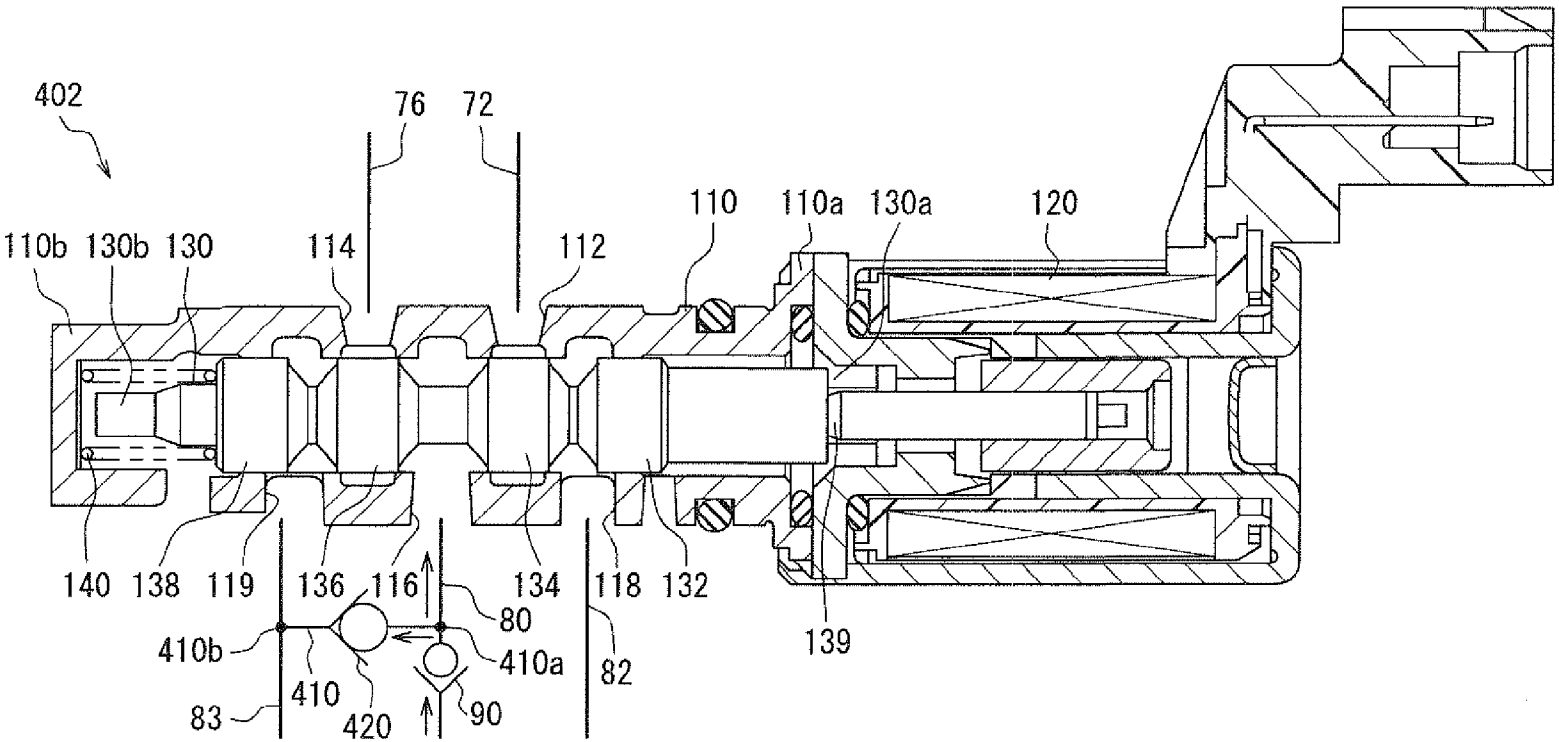
FIG. 21 is a cross-sectional view schematically showing still another operational state of the spool valve in FIG. 18.

More particularly, one end 410*a* of the connection passage 410 communicates with the supply passage 80 at a position located on a side of the supply port 116 toward the pump 4. Further, the other end 410*b* of the connection passage 410 communicates with the drain passage 83 at a position located on a side of the drain port 119 toward the oil pan 5. Accordingly, as shown in FIGS. 19 to 21, the connection passage 410 always connects the supply passage 80 to the drain passage 83.

The check valve 420 is provided in the connection passage 410 having the above structure such that the check valve 420 limits hydraulic oil from flowing in a direction (valve-closed direction) from the one end 410*a* toward the other end 410*b*. Accordingly, the check valve 420 is closed as shown in FIG. 19 to regulate a flow of hydraulic oil from the one end 410*a* toward the other end 410*b* in the connection passage 410. On the other hand, the check valve 420 is opened as shown in FIG. 22 to allow a flow of hydraulic oil in the opposite direction opposite to the above valve-closed direction.

Hereinbelow, the valve timing control operations according to the fourth embodiment will be described in detail.

(1) Advance Operation

Figure 22:
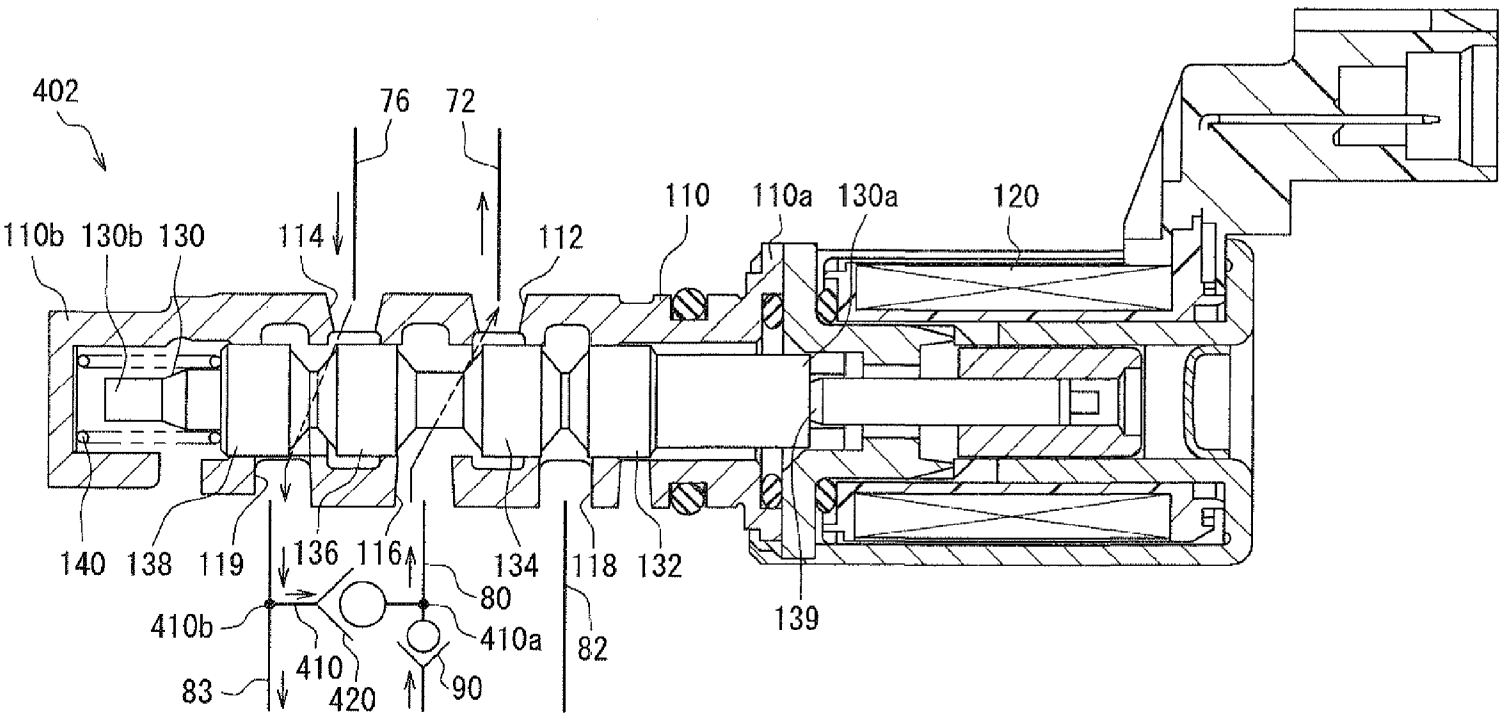
FIG. 22 is a cross-sectional view schematically showing still another operational state of the spool valve in FIG. 18.

In a case, where the spool 130 is in the advance position such that the supply port 116 and the drain port 119 are connected to the advance port 112 and the retard port 114 as shown in FIG. 22, when the negative torque acts on the vane rotor 14, hydraulic oil supplied from the pump 4 to the supply passage 80 is supplied through the supply and advance ports 116, 112 to the advance chambers 52 to 54. Further, hydraulic oil in the retard chambers 56 to 58 is compressed with the vane rotor 14 actuated by the negative torque, and hydraulic oil in the retard chambers 56 to 58 flows through the retard port 114 into the drain port 119, and thereby is discharged through the drain passage 83 to the oil pan 5. The hydraulic oil also flows into the connection passage 410 connected to the drain passage 83. At this time, the check valve 420 is opened against the pressure of the supplied hydraulic oil in the supply passage 80, thereby allows a flow of hydraulic oil toward the supply passage 80. Accordingly, hydraulic oil flowed in the connection passage 410 can be supplied through the ports 116, 112 to the advance chambers 52 to 54. Even when the amount of hydraulic oil supply is reduced, hydraulic oil is replenished from the drain passage 83, and thereby shortage of hydraulic oil in the advance chambers 52 to 54, the volume of each of which is expanded, is suppressed.

On the other hand, when the positive torque acts on the vane rotor 14 and the advance chambers 52 to 54 are compressed with the vane rotor 14, hydraulic oil is to flow backward from the advance port 112 to the supply passage 80, and further to the connection passage 410 as shown in FIG. 19. However, at this time, in the supply passage 80, a flow of hydraulic oil toward the pump 4 is regulated with the check valve 90, and in the connection passage 410, a flow of hydraulic oil toward the drain passage 83 is regulated with the check valve 420. Accordingly, outflow of hydraulic oil from the advance chambers 52 to 54 is suppressed, and further, erroneous supply of hydraulic oil through the drain passage 83 and the ports 119, 114 to the retard chambers 56 to 58 can be avoided.

As described above, it is possible to supply a sufficient amount of hydraulic oil to the advance chambers 52 to 54 and also to discharge hydraulic oil from the retard chambers 56 to 58. Even when the average torque of the variable torque is biased in the retard direction, the advance response is reliably improved.

(2) Retard Operation

Figure 23:
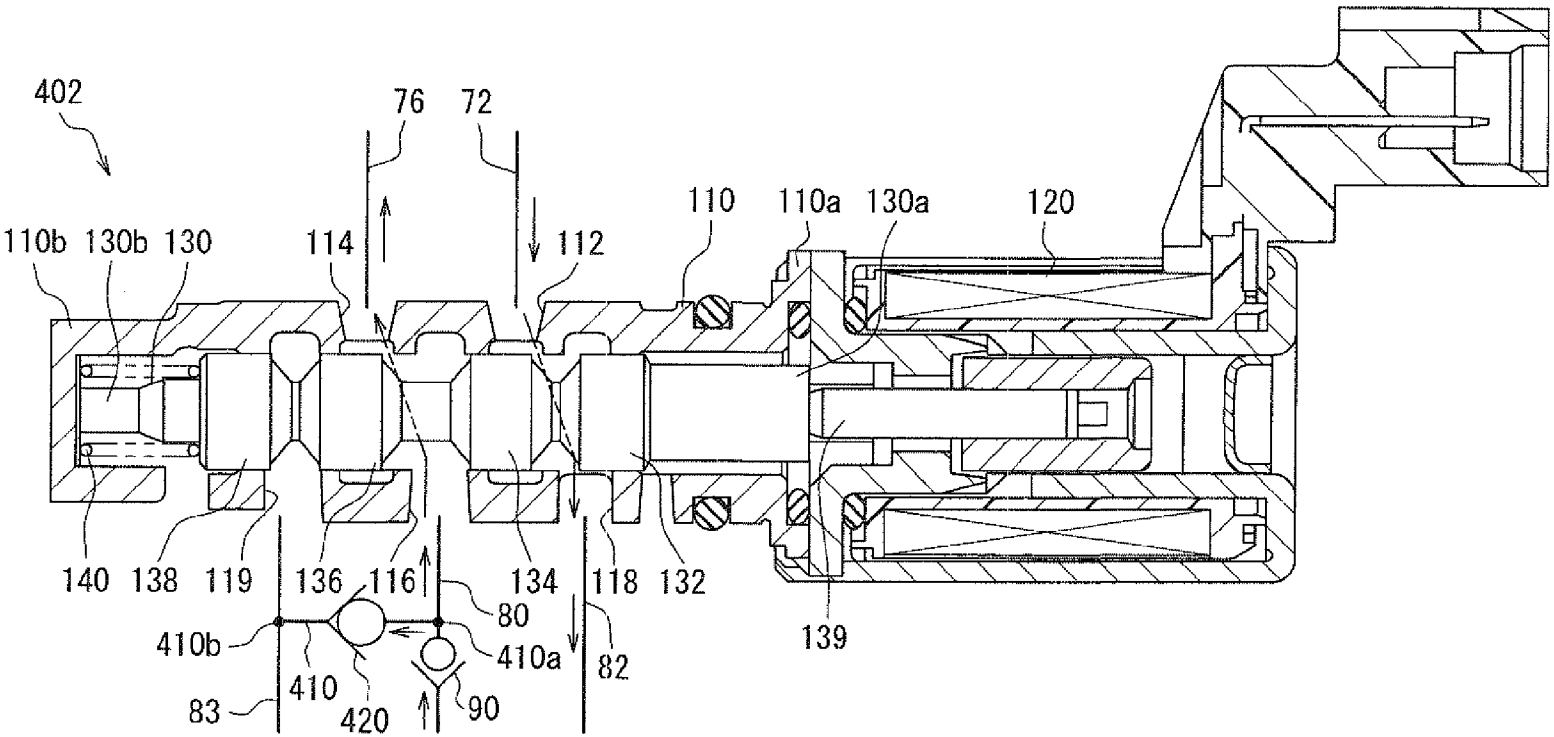
FIG. 23 is a cross-sectional view schematically showing still another operational state of the spool valve in FIG. 18.

In a case, where the spool 130 is in the retard position such that the supply port 116 and the drain port 118 are connected to the retard port 114 and the retard port 112 as shown in FIG. 23, when the positive torque acts on the vane rotor 14, hydraulic oil supplied from the pump 4 to the supply passage 80 is supplied through the supply and retard ports 116, 114 to the retard chambers 56 to 58. At this time, hydraulic oil flows into the connection passage 410 connected to the supply passage 80. However, because the check valve 420 regulates a flow of hydraulic oil toward the drain passage 83, discharge of a part of hydraulic oil supplied from the pump 4 to the oil pan 5 is avoided. Note that at this time, hydraulic oil in the advance chambers 52 to 45 is compressed with the vane rotor 14 actuated by the positive torque and flows through the advance port 112 into the drain port 118, and thereby is discharged through the drain passage 82 to the oil pan 5.

On the other hand, when the negative torque acts on the vane rotor 14 and thereby hydraulic oil in the retard chambers 56 to 58 is compressed with the vane rotor 14, hydraulic oil is to flow backward from the retard port 114 to the supply passage 80 and further to the connection passage 410 as shown in FIG. 20. However, at this time, in the supply passage 80, a flow of hydraulic oil toward the pump 4 is regulated with the check valve 90, and in the connection passage 410, a flow of hydraulic oil toward the drain passage 83 is regulated with the check valve 420. Accordingly, it is possible to suppress outflow of hydraulic oil from the retard chambers 56 to 58, and thereby the retard response is reliably improved.

(3) Holding Operation

In a case, where the spool 130 is in the hold position such that the supply port 116 and the drain port 118 are disconnected from the retard port 114 and the advance port 112 as shown in FIG. 21, hydraulic oil supplied from the pump 4 to the supply passage 80 is not supplied to any of the advance chambers 52 to 54 and the retard chambers 56 to 58, and outflow of hydraulic oil from the advance chambers 52 to 54 and the retard chambers 56 to 58 is regulated. Accordingly, changes of the engine phase are suppressed, and the valve timing can be substantially held. Note that at this time, although hydraulic oil flows from the supply port 116 into the connection passage 410, a flow of hydraulic oil toward the drain passage 83 is regulated with the check valve 420.

According to the above-described fourth embodiment, it is possible to quickly and precisely control valve timing appropriately to an operational state of the internal combustion engine. Note that in the above-described fourth embodiment, the controller 400 corresponds to the "controller"; the drain passage 83 corresponds to the "first drain passage"; the drain passage 82 corresponds to the "second drain passage"; and the check valve 420 corresponds to the "main check valve".

Fifth Embodiment

Figure 24:
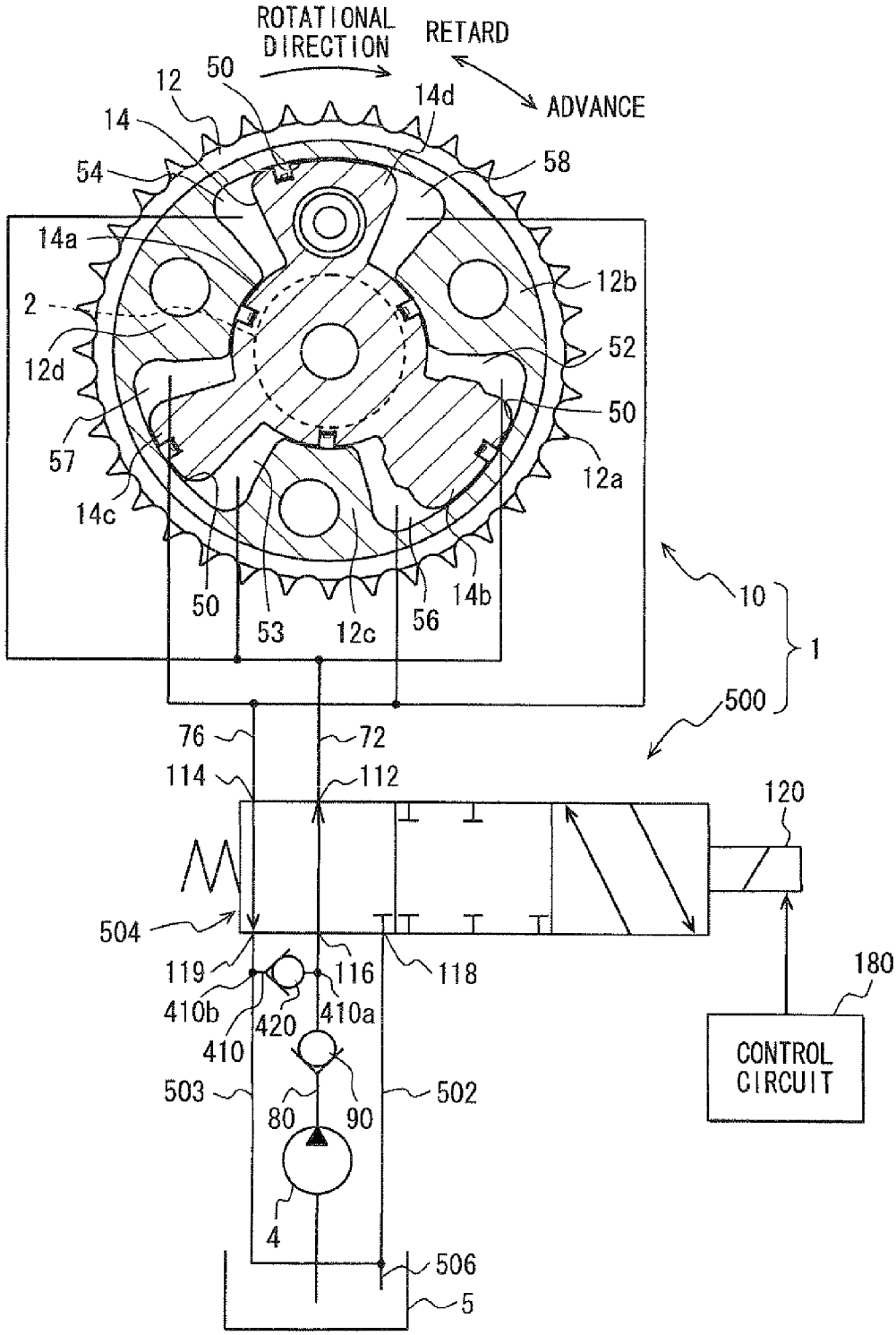
FIG. 24 is a block diagram showing the valve timing control apparatus according to a fifth embodiment of the present invention.
Figure 25:
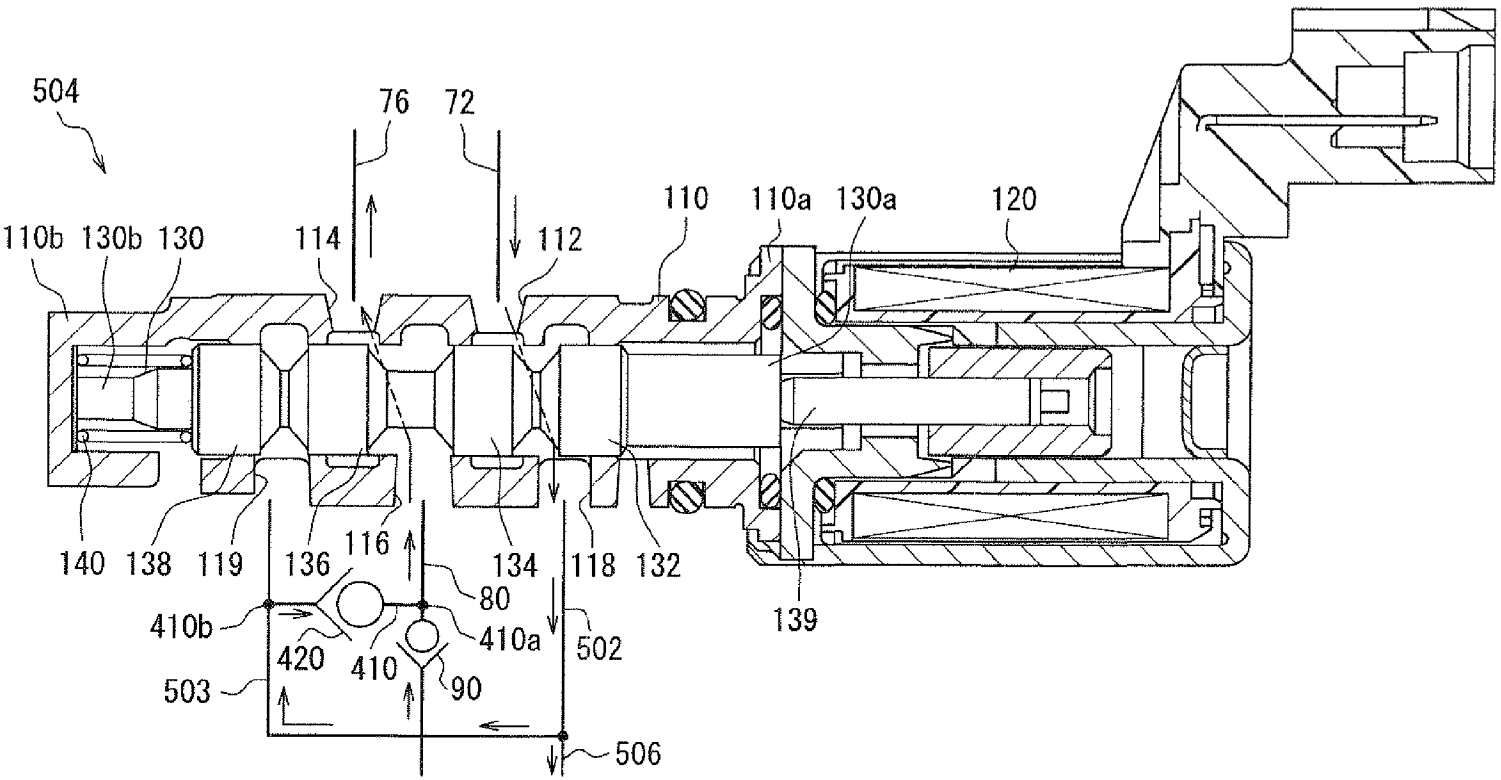
FIG. 25 is a cross-sectional view schematically showing the detailed structure and an operational state of the spool valve in FIG. 24.

The fifth embodiment of the present invention is a modification of the fourth embodiment. As shown in FIGS. 24, 25, in a controller 500 according to the fifth embodiment, drain passages 502, 503, which communicates with the drain ports 118, 119, communicate with each other, such that hydraulic oil can be discharged through a common passage 506 to the oil pan 5. In the above, the common passage 506 is provided on a side of the drain passages 502, 503 opposite to a spool valve 504. In the present embodiment, the connection passage 410 always connects the supply passage 80 to the drain passage 503.

Hereinbelow, among the valve timing control operations according to the fifth embodiment, the retard operation different from that in the fourth embodiment will be described.

As shown in FIG. 25, in a case, where the spool 130 is in the retard position, when the positive torque acts on the vane rotor 14, hydraulic oil is compressed in the advance chambers 52 to 54 and flows through the advance port 112 into the drain port 118 and the drain passage 502 sequentially. A part of hydraulic oil, which flows through the drain passage 502, is discharged to the oil pan 5, and the remaining hydraulic oil flows from the drain passage 503, which communicates with the drain passage 502, into the connection passage 410. At this time, the check valve 420 is opened against the pressure of the supplied hydraulic oil in the supply passage 80, thereby allows a flow of hydraulic oil toward the supply passage 80. Accordingly, hydraulic oil flowed in the connection passage 410 is supplied through the supply and the retard ports 116, 114 to the retard chambers 56 to 58. When the amount of hydraulic oil supply is reduced, as hydraulic oil is replenished from the drain passage 503, shortage of hydraulic oil in the retard chambers 56 to 58, the volume of each of which is expanded, is suppressed. Accordingly, the retard response is reliably improved.

According to the above-described fifth embodiment, it is possible to more quickly and more precisely control valve timing appropriately to an operational state of the internal combustion engine. Note that in the above-described fifth embodiment, the controller 500 corresponds to the "controller"; the drain passage 503 corresponds to the "first drain passage"; and the drain passage 502 corresponds to the "second drain passage".

Sixth Embodiment

Figure 26:
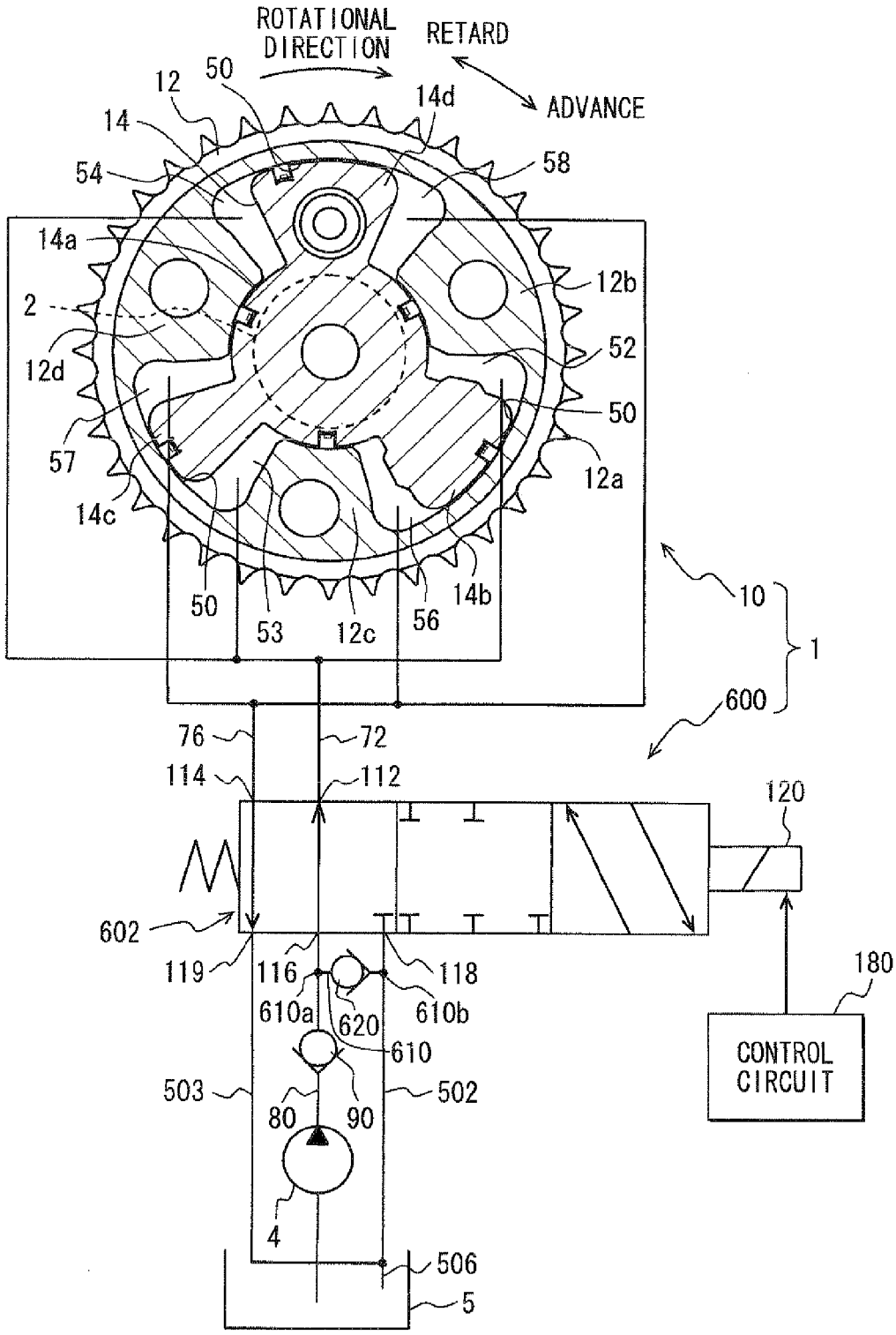
FIG. 26 is a block diagram showing the valve timing control apparatus according to a sixth embodiment of the present invention.
Figure 27:
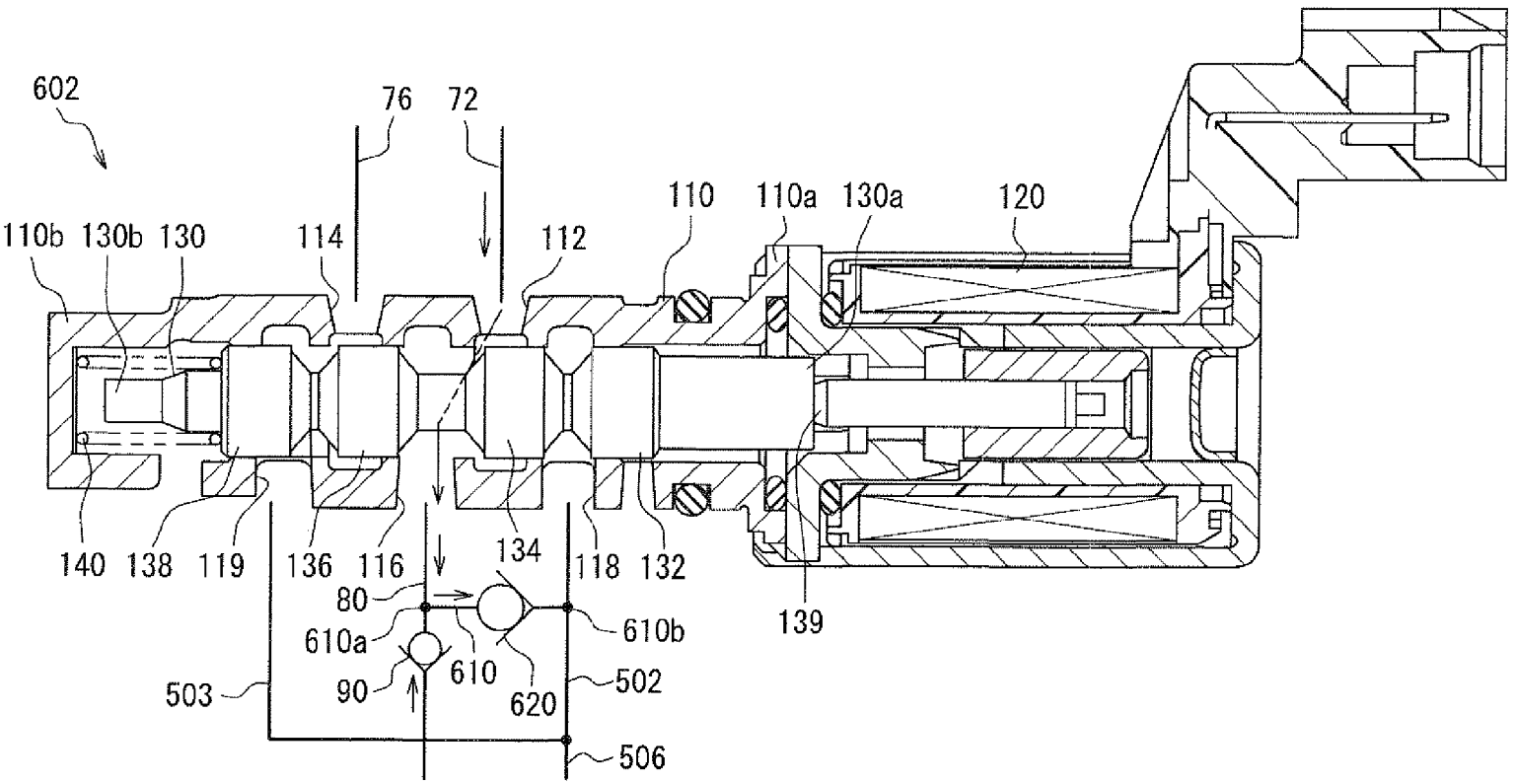
FIG. 27 is a cross-sectional view schematically showing the detailed structure and an operational state of the spool valve in FIG. 26.
Figure 28:
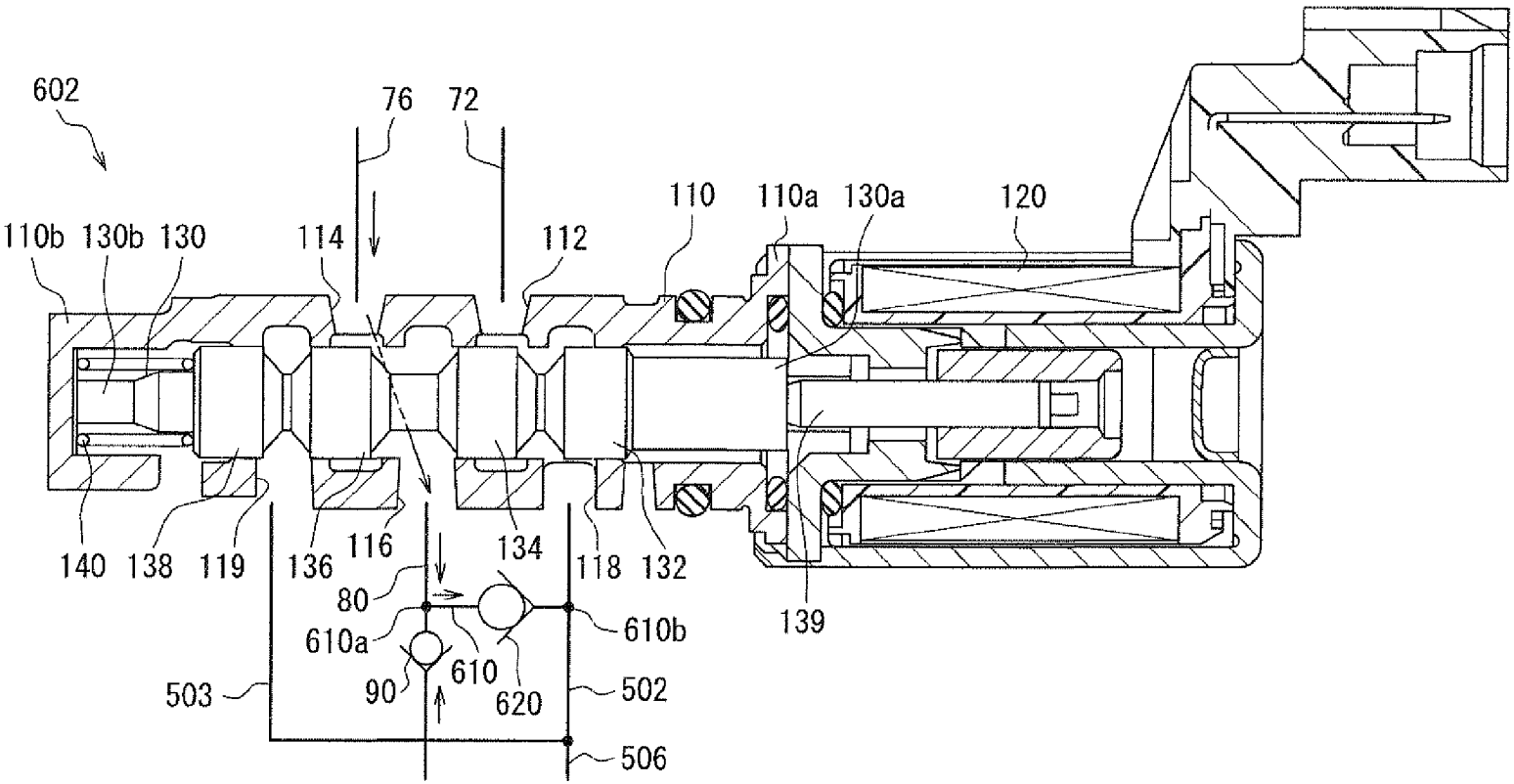
FIG. 28 is a cross-sectional view schematically showing another operational state of the spool valve in FIG. 26.

The sixth embodiment of the present invention is a modification of the fifth embodiment. As shown in FIGS. 26, 27, in a controller 600 according to the sixth embodiment, a connection passage 610, in which a check valve 620 is provided, has one end 610*a* and the other end 610*b*. The one end 610*a* communicates with the supply port 116. The other end 610*b* is provided to a side of the connection passage 610 opposite to the one end 610*a*, and communicates with the drain passage 502 at a position on a side of the drain port 118 toward the oil pan 5. Accordingly, as shown in FIGS. 27, 28, the connection passage 610 always connects the supply passage 80 to the drain passage 502. Further, the check valve 620 is closed to limit hydraulic oil from flowing in a direction (valve-close direction) from the one end 610*a* toward the other end 610*b*.

Hereinbelow, among the valve timing control operations according to the sixth embodiment, the advance operation and the retard operation different from those in the fifth embodiment will be described.

Figure 29:
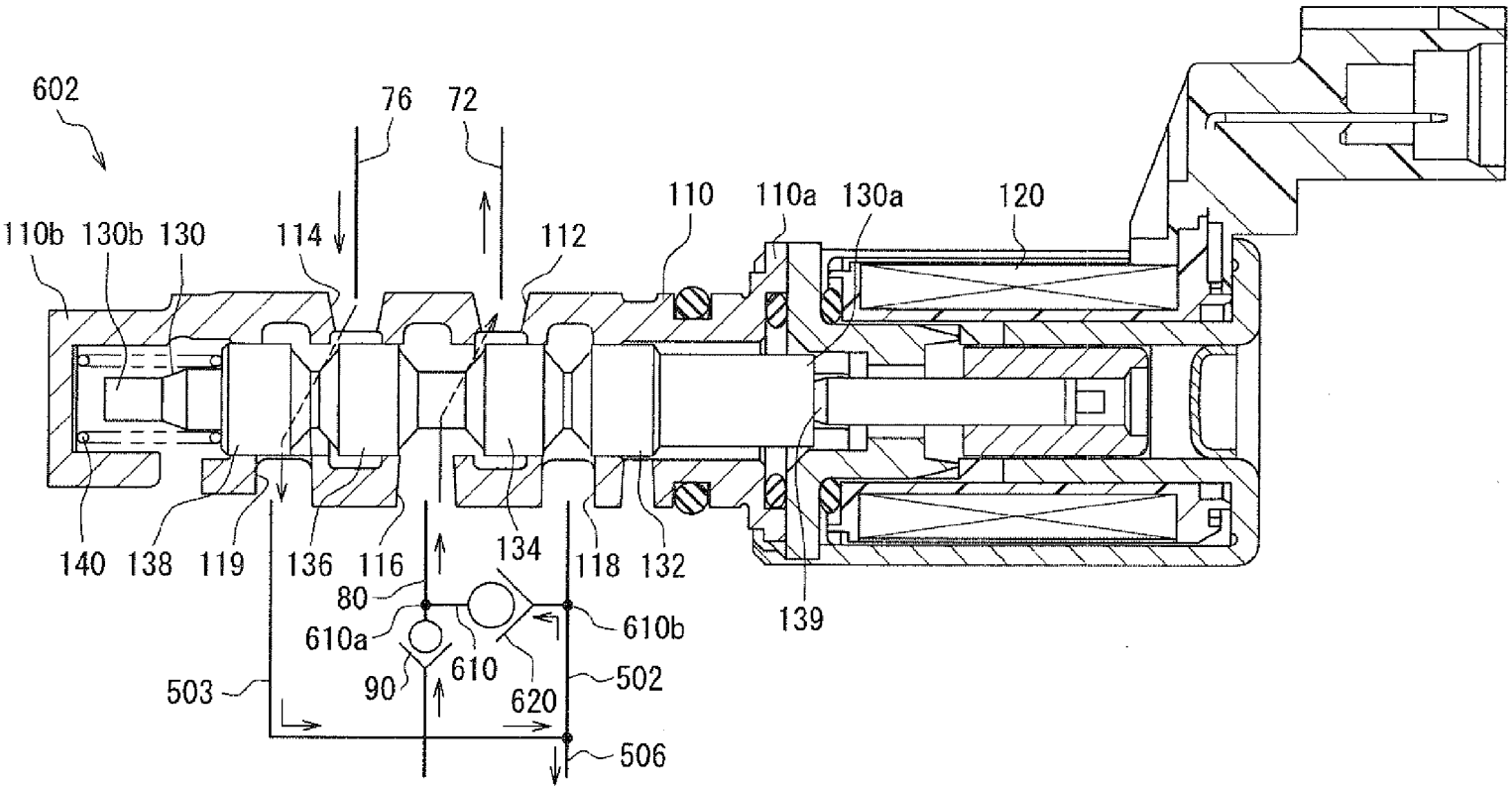
FIG. 29 is a cross-sectional view schematically showing still another operational state of the spool valve in FIG. 26.

First, the advance operation will be described. In a case, where the spool 130 is in the advance position as shown in FIG. 29, when the negative torque acts on the vane rotor 14, hydraulic oil is compressed in the retard chambers 56 to 58 and flows through the retard port 114 into the drain port 119 and the drain passage 503 sequentially. A part of hydraulic oil, which flows through the drain passage 503, is discharged to the oil pan 5, and the remaining hydraulic oil flows through the drain passage 502, which communicates with the drain passage 503, into the connection passage 610. At this time, the check valve 620 is opened against the pressure of the supplied hydraulic oil in the supply passage 80, thereby allows a flow of hydraulic oil toward the supply passage 80. Accordingly, hydraulic oil in the connection passage 610 is supplied through the supply and advance ports 116, 112 to the advance chambers 52 to 54. When the amount of hydraulic oil supply is reduced, as hydraulic oil can be replenished from the drain passage 503 side through the drain passage 502, shortage of hydraulic oil in the advance chambers 52 to 54, the volume of each of which is expanded is suppressed.

On the other hand, in a case, where the spool 130 is in the advance position, when the positive torque acts on the vane rotor 14 and thereby the advance chambers 52 to 54 are compressed, hydraulic oil is to flow backward from the advance port 112 to the supply passage 80 and further to the connection passage 610 as shown in FIG. 27. However, at this time, in the supply passage 80, a flow of hydraulic oil toward the pump 4 is regulated with the check valve 90, and in the connection passage 610, a flow of hydraulic oil toward the drain passage 502 is regulated with the check valve 620. Accordingly, outflow of hydraulic oil from the advance chambers 52 to 54 is suppressed, and further, erroneous supply of hydraulic oil through the drain passages 502, 503 and the ports 119, 114 to the retard chambers 56 to 58 is avoided.

As described above, it is possible to supply a sufficient amount of hydraulic oil to the advance chambers 52 to 54 and to discharge hydraulic oil from the retard chambers 56 to 58. Even when the average torque of the variable torque is biased in the retard direction, the advance response is reliably improved.

Figure 30:
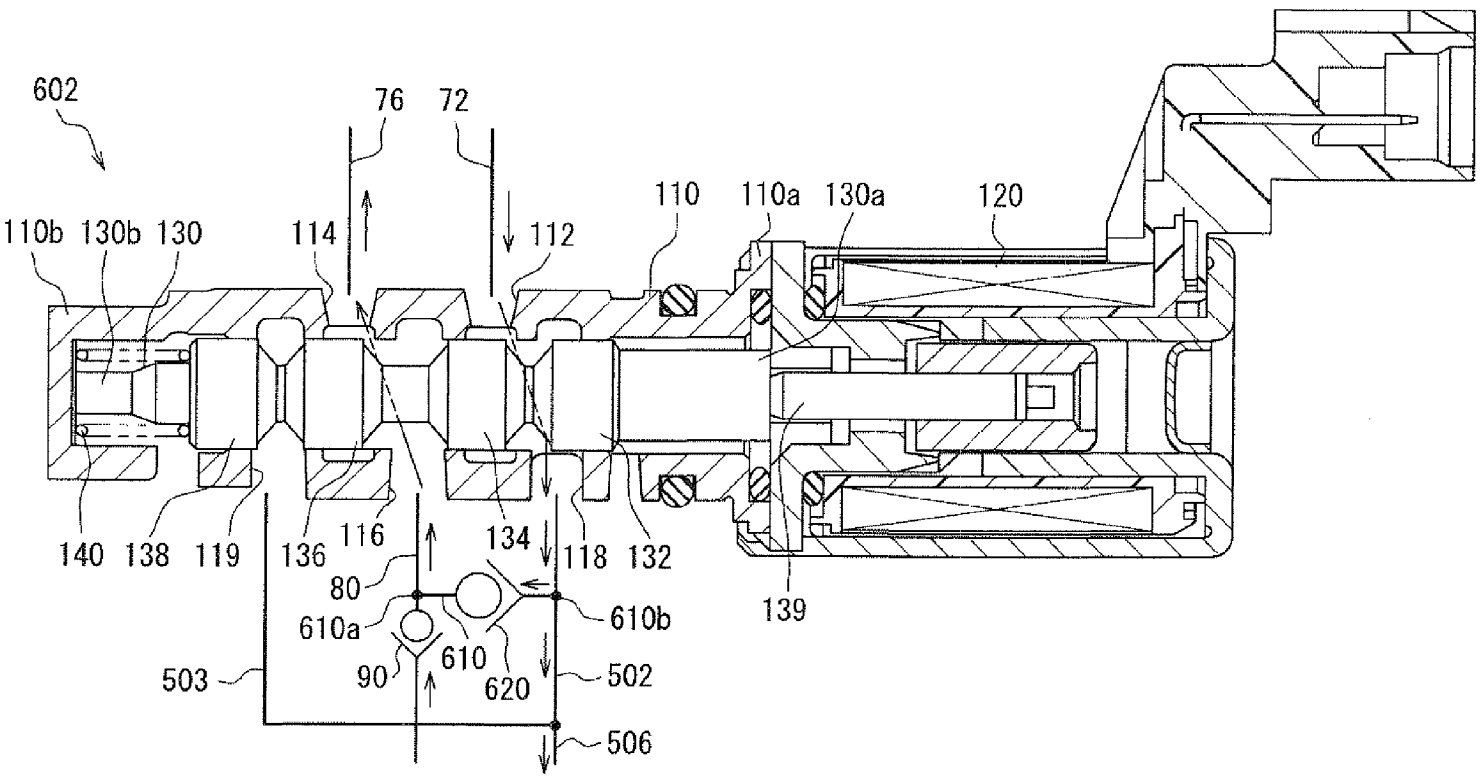
FIG. 30 is a cross-sectional view schematically showing still another operational state of the spool valve in FIG. 26.

Next, the retard operation will be described. In a case, where the spool 130 is in the retard position as shown in FIG. 30, when the positive torque acts on the vane rotor 14, hydraulic oil is compressed in the advance chambers 52 to 54 and flows through the advance port 112 into the drain port 118, and thereby is discharged through the drain passage 502 to the oil pan 5. The hydraulic oil also flows into the connection passage 610 connected to the drain passage 502. At this time, the check valve 620 is opened against the pressure of the supplied hydraulic oil in the supply passage 80, thereby allows a flow of hydraulic oil toward the supply passage 80. Accordingly, hydraulic oil flowed in the connection passage 610 is supplied through the supply and retard ports 116, 114 to the retard chambers 56 to 58. When the amount of hydraulic oil supply is reduced, as hydraulic oil can be replenished from the drain passage 502, shortage of hydraulic oil in the retard chambers 56 to 58, the volume of each of which is expanded, is suppressed.

On the other hand, when the negative torque acts on the vane rotor 14 and the retard chambers 56 to 58 are compressed, hydraulic oil is to flow backward through the retard port 114 to the supply passage 80, and further to the connection passage 610 as shown in FIG. 28. However, at this time, in the supply passage 80, a flow of hydraulic oil toward the pump 4 is regulated with the check valve 90, and in the connection passage 610, a flow of hydraulic oil toward the drain passage 502 is regulated with the check valve 620. Accordingly, outflow of hydraulic oil from the retard chambers 56 to 58 is suppressed.

As described above, it is possible to supply a sufficient amount of hydraulic oil to the retard chambers 56 to 58 and also to discharge hydraulic oil from the advance chambers 52 to 54. As a result, the retard response is reliably improved.

In this manner, according to the sixth embodiment, it is possible to more quickly and more precisely control valve timing appropriately to an operational state of the internal combustion engine. Note that in the above-described sixth embodiment, the controller 600 corresponds to the "controller"; and the check valve 620 corresponds to the "main check valve".

Seventh Embodiment

Figure 31:
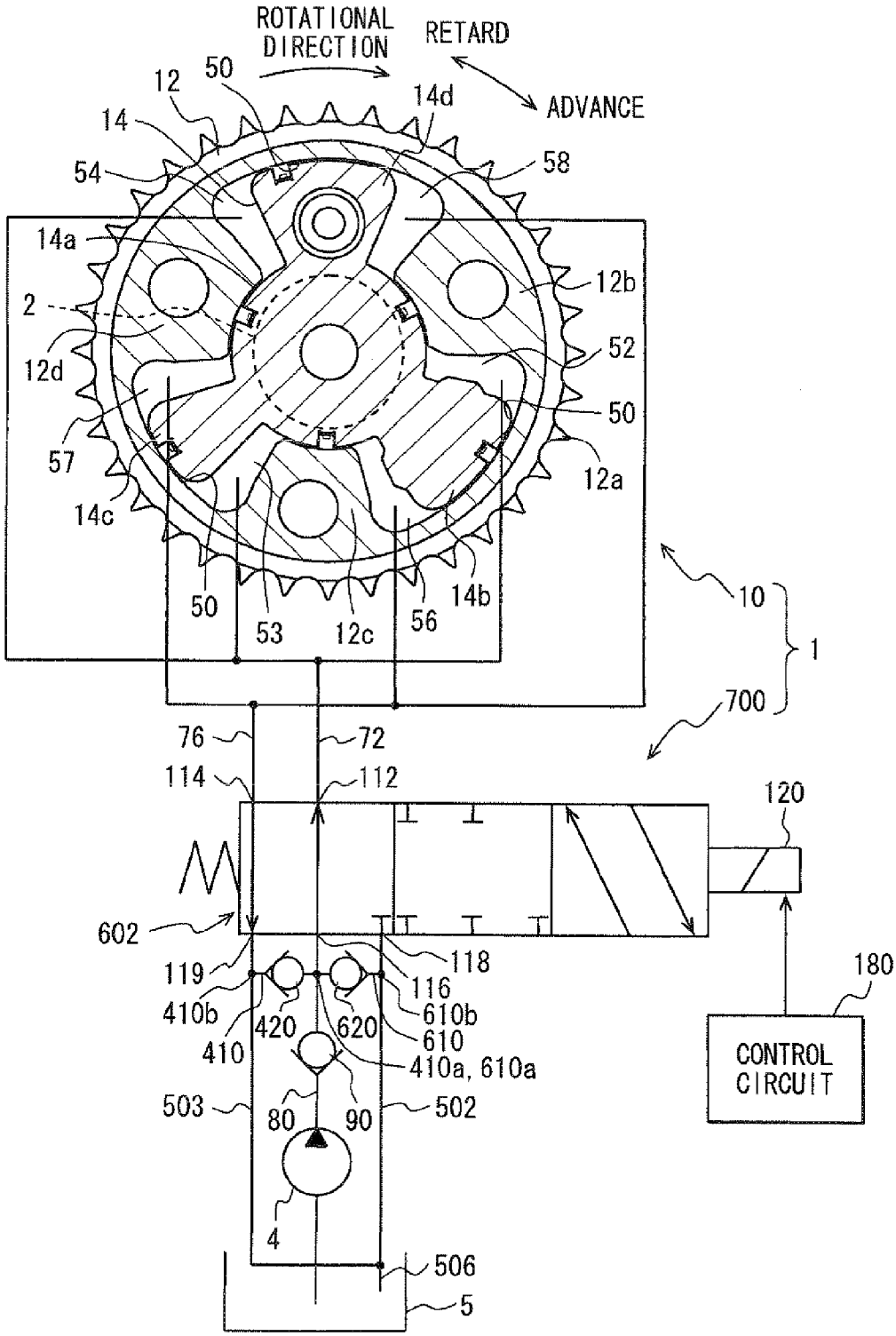
FIG. 31 is a block diagram showing the valve timing control apparatus according to a seventh embodiment of the present invention.
Figure 32:
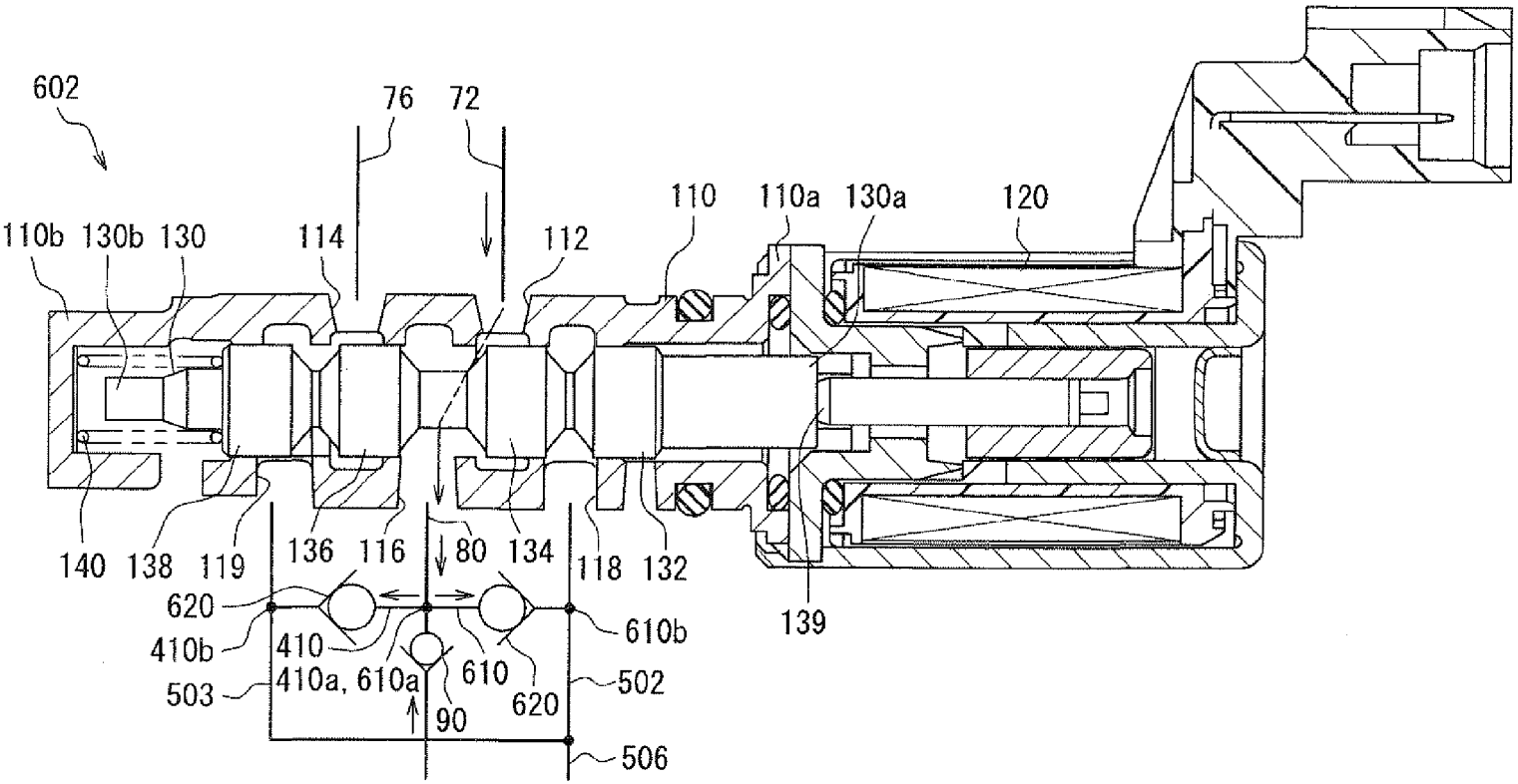
FIG. 32 is a cross-sectional view schematically showing the detailed structure and an operational state of the spool valve in FIG. 31.

The seventh embodiment of the present invention is a modification of the fifth and sixth embodiments. As shown in FIGS. 31, 32, in a controller 700 according to the seventh embodiment, the connection passage 610 and the check valve 620 in the sixth embodiment are applied to the structure in the fifth embodiment.

Hereinbelow, among the valve timing control operations according to the seventh embodiment, the advance operation and the retard operation different from those in the fifth and sixth embodiments will be described.

Figure 33:
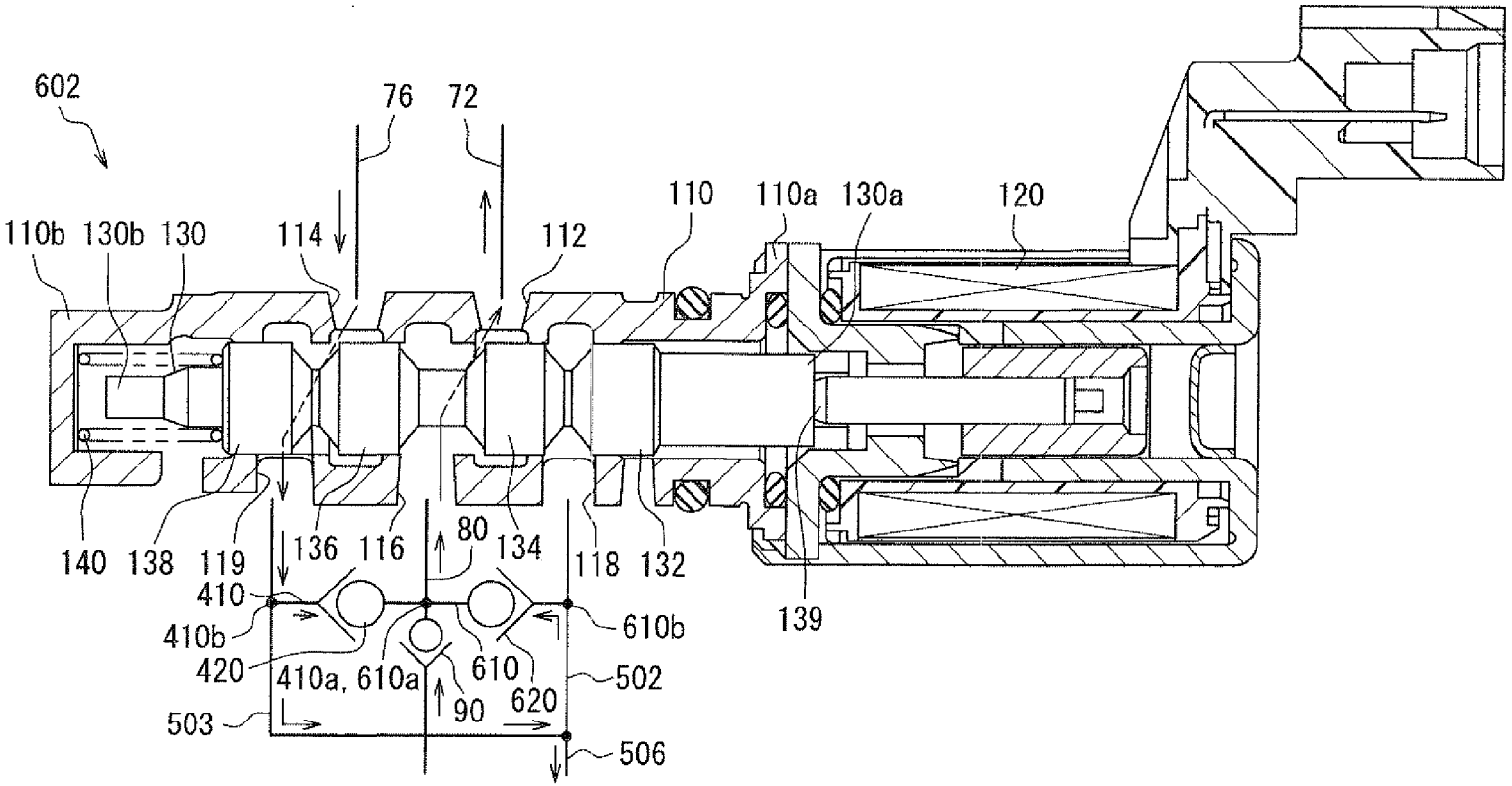
FIG. 33 is a cross-sectional view schematically showing another operational state of the spool valve in FIG. 31.

First, the advance operation will be described. In a case, where the spool 130 is in the advance position as shown in FIG. 33, when the negative torque acts on the vane rotor 14, hydraulic oil is compressed in the retard chambers 56 to 58 and flows through the retard port 114 into the drain port 119 and the drain passage 503 sequentially. A part of hydraulic oil, which flows through the drain passage 503, is discharged to the oil pan 5, and the remaining hydraulic oil flows through the drain passage 503 into the connection passage 410, and flows through the drain passage 502, which communicates with the drain passage 503, into the connection passage 610. At this time, the check valves 420, 620 are opened against the pressure of the supplied hydraulic oil in the supply passage 80, thereby allow flows of hydraulic oil toward the supply passage 80. Accordingly, hydraulic oil flowed in the connection passages 410, 610 can be supplied to the advance chambers 52 to 54. When the amount of hydraulic oil supply is reduced, hydraulic oil is replenished from the drain passage 503 and from the drain passage 502. Accordingly, it is possible to supply hydraulic oil to the advance chambers 52 to 54, the volume of each of which is expanded, without shortage, thereby sufficiently improve the advance response.

Figure 34:
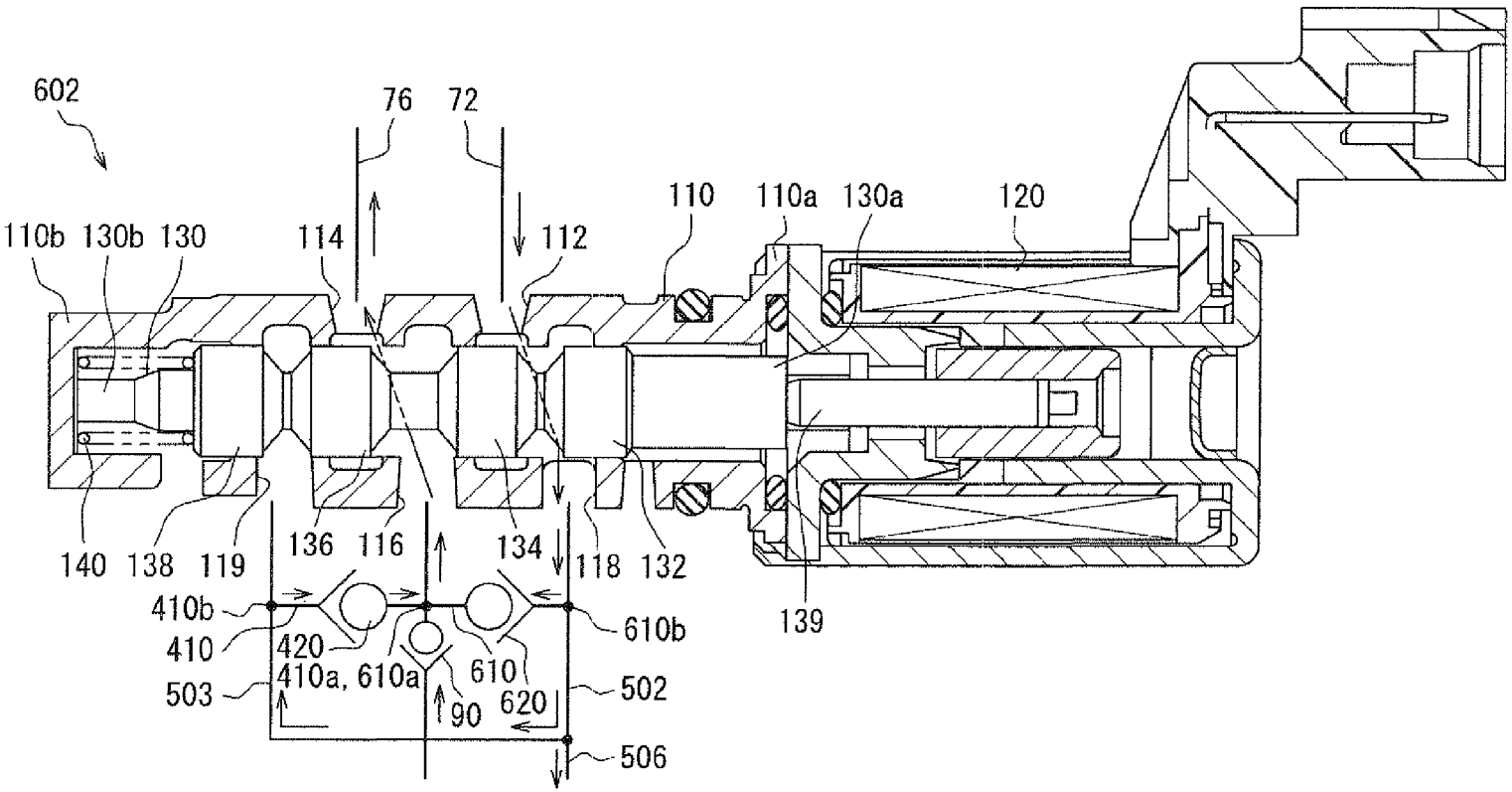
FIG. 34 is a cross-sectional view schematically showing still another operational state of the spool valve in FIG. 31.

Next, the retard operation will be described. In a case, where the spool 130 is in the retard position as shown in FIG. 34, when the positive torque acts on the vane rotor 14, hydraulic oil is compressed in the advance chambers 52 to 54 and flows through the advance port 112 into the drain port 118 and the drain passage 502 sequentially. A part of hydraulic oil, which flows through the drain passage 502, is discharged to the oil pan 5, and the remaining hydraulic oil flows through the drain passage 502 into the connection passage 610, and flows through the drain passage 503, which communicates with the drain passage 502, into the connection passage 410. At this time, the respective check valves 620, 420 are opened against the pressure of the supplied hydraulic oil in the supply passage 80, thereby allow flows of hydraulic oil toward the supply passage 80. Accordingly, hydraulic oil flowed in the respective connection passages 610, 410 can be supplied to the retard chambers 56 to 58. When the amount of hydraulic oil supply is reduced, hydraulic oil can be replenished from the drain passage 502 and from the drain passage 503. Accordingly, it is possible to supply hydraulic oil to the retard chambers 56 to 58, the volume of each of which is expanded, without shortage, and thereby sufficiently improve the retard response.

According to the above-described seventh embodiment, it is possible to more quickly and more precisely control valve timing appropriately to an operational state of the internal combustion engine. Note that in the above-described seventh embodiment, the controller 700 corresponds to the "controller"; the connection passage 410 corresponds to the "first connection passage"; the connection passage 610 corresponds to the "second connection passage"; the check valve 420 corresponds to the "first check valve"; the check valve 620 corresponds to the "second check valve", and these check valves 420, 620 correspond to the "main check valve" respectively.

Other Embodiment

While the present invention has been described in connection with the above preferred embodiments, the invention is not to be interpreted limitedly to those specific embodiments. On the contrary, the invention is applicable to various modifications and equivalents within the spirit and scope of the invention.

More particularly, in the first to seventh embodiments, it may be arranged such that the average torque $T_{ave}$ of the variable torque is substantially zero or slightly biased in the positive torque direction (i.e., in the retard direction to retard the phase of the camshaft 2). Further, in the first to seventh embodiments, it may be arranged such that the driving unit 10 is provided with a resilient member, such as an assist spring, to press the camshaft 2 in an opposite direction opposite to a direction, in which the average torque $T_{ave}$ of the variable torque is applied. Further, in the first to seventh embodiment, it may be arranged such that in the driving unit 10, the housing 12 may be rotatable with the camshaft 2, and the vane rotor 14 may be rotatable with the crankshaft.

In the first to seventh embodiment, regarding the spool valves 100, 202, 304, 402, 504, in addition to the driving of the spool 130 with the solenoid 120, it may be arranged such that the spool 130 may be alternatively driven with a piezo actuator, a hydraulic actuator or the like.

In the first embodiment, it may be arranged such that the port 114 communicates with the advance passage 72 and such that the port 112 communicates with the retard passage 76. In the above case, the position in FIGS. 3, 6 indicates the retard position for the retard operation, and the position in FIGS. 4, 7 indicates the advance position for the advance operation. Further, as in the case of the third embodiment, the check valves 210, 230 may be provided with the pressing members 316, 336 in the second embodiment.

In the first embodiment, as in the case of the third embodiment, it may be arranged such that the drain passages 82, 83 communicate with each other. Further, in the sixth and seventh embodiments, as in the case of the fourth embodiment, it may be arranged such that the drain passages 502, 503 do not directly communicate with each other.

Further, the present invention is applicable to, in addition to an apparatus for valve timing control of an intake valve, an apparatus for valve timing control of an exhaust valve serving as a "valve", or an apparatus for valve timing of both intake and exhaust valves.

In the above embodiment, when the spool 130 is moved to one of the advance position and the retard position, the connection passage connects the supply passage 80 with the corresponding drain passage. When the spool is moved to the other one of the advance position and the retard position, the supply passage and the drain passage are disconnected from each other. In the above arrangement, the check valve may be provided in the connection passage such that the check valve is capable of improving or facilitating the response in only required one of the advance direction and the retard direction. In the above, there may be specially needed to improve the response in changing the engine phase in the required direction. As a result, the life of the check valve is extended. Accordingly, in such case, the high response in the selected or required direction is ensured for a long period of time.

In the above embodiment, only in a case, where the spool 130 is moved to one of the advance position and the retard position, one of the retard chamber and the advance chamber is connected to one of the first drain passage and the second drain passage, which is always connected to the supply passage by the connection passage. In the above configuration, the check valve may be provided in the connection passage such that the check valve is capable of improving or facilitating the response in only required one of the advance direction and the retard direction. In the above, there may be specially needed to improve the response in changing the engine phase in the required direction. As a result, the life of the check valve is extended. Accordingly, in such case, high response in the selected or required direction is ensured for a long period.

Additional advantages and modifications will readily occur to those skilled in the art. The invention in its broader terms is therefore not limited to the specific details, representative apparatus, and illustrative examples shown and described.

What is claimed is:

1. A valve timing control apparatus for controlling valve timing of a valve that is opened and closed by a camshaft through torque transmitted from a crankshaft in an internal combustion engine, the valve timing control apparatus comprising:

a first rotor that is rotatable with the crankshaft;

a second rotor that is rotatable with the camshaft, wherein:

the second rotor and the first rotor define therebetween an advance chamber and a retard chamber, which are circumferentially arranged one after another;

the second rotor drives the camshaft with respect to the crankshaft in an advance direction when working fluid is supplied to the advance chamber; and the second rotor drives the camshaft with respect to the crankshaft in a retard direction when working fluid is supplied to the retard chamber; and a controller that includes:

a supply passage, through which working fluid is supplied from an external fluid supply source;

first and second drain passages, through which working fluid is discharged, wherein the controller controls a connection state of each of the supply passage and the first and second drain passages with a corresponding one of the advance chamber and the retard chamber;

a spool valve that includes a spool, which is reciprocably movable, wherein:

the spool valve connects the supply passage to the advance chamber and connects the first drain passage to the retard chamber by moving the spool to an advance position in order to advance a phase of the camshaft with respect to the crankshaft; and the spool valve connects the supply passage to the retard chamber and connects the second drain passage to the advance chamber by moving the spool to a retard position in order to retard the phase;

at least one connection passage that connects the supply passage to a corresponding one of the first and second drain passages when the spool is moved to one of the advance position and the retard position; and at least one check valve that is provided respectively in the at least one connection passage, wherein:

the at least one check valve allows working fluid to flow in a first direction from the corresponding one of the first and second drain passages toward the supply passage; and the at least one check valve limits working fluid from flowing in a second direction from the supply passage toward the corresponding one of the first and second drain passages, wherein:

the at least one connection passage includes:

a first connection passage that connects the supply passage to the first drain passage when the spool is moved to the advance position; and a second connection passage that connects the supply passage to the second drain passage when the spool is moved to the retard position;

the first and second connection passages are defined inside the spool; and the at least one check valve includes:

a first check valve that is provided in the first connection passage, inside the spool; and a second check valve that is provided in the second connection passage, inside the spool.

2. The valve timing control apparatus according to claim 1, wherein:

the spool disconnects the supply passage from the other one of the first and second drain passages when the spool is moved to the other one of the advance position and the retard position.

3. The valve timing control apparatus according to claim 1, wherein:

the first drain passage and the second drain passage communicate with each other;

the first connection passage of the spool connects the supply passage to the first drain passage when the spool is moved to the retard position; and the second connection passage of the spool connects the supply passage to the second drain passage when the spool is moved to the advance position.

4. The valve timing control apparatus according to claim 1, wherein:

the at least one connection passage always connects the supply passage to the corresponding one of the first and second drain passages.

5. The valve timing control apparatus according to claim 4, wherein:

the second drain passage communicates with the first drain passage; and the at least one connection passage always connects the first drain passage to the supply passage.

6. The valve timing control apparatus according to claim 4, wherein:

the second drain passage communicates with the first drain passage; and the at least one connection passage always connects the second drain passage to the supply passage.

7. The valve timing control apparatus according to claim 4, wherein:

the first connection passage always connects the supply passage to the first drain passage; and the second connection passage always connects the supply passage to the second drain passage.

8. The valve timing control apparatus according to claim 7, wherein:

the first drain passage and the second drain passage communicate with each other.

9. The valve timing control apparatus according to claim 1, wherein:

the controller further has a sub check valve that is provided in the supply passage;

the sub check valve allows working fluid to flow in a third direction from the fluid supply source toward the spool valve; and the sub check valve limits working fluid from flowing in a fourth direction from the spool valve toward the fluid supply source.

10. The valve timing control apparatus according to claim 1, wherein:

each of the first check valve and the second check valve has a ball shape.

11. The valve timing control apparatus according to claim 1, wherein:

the first check valve comprises a ball-shaped valve body, the first connection passage is defined in an axial direction of said spool, and the ball-shape valve body selectively engages a valve seat defined by the spool in surrounding relation to said first connection passage to selectively block flow through said first connection passage.

12. The valve timing control apparatus according to claim 11, wherein:

said first check valve is provided with a pressing member provided in the first connection passage, the pressing member pressing the valve body to the valve seat by compression deformation.

13. The valve timing control apparatus according to claim 11, wherein:

the first drain passage and the second drain passage communicate with each other.

14. The valve timing control apparatus according to claim 1, wherein:

the second check valve comprises a ball-shaped valve body, the second connection passage is defined in an axial direction of said spool, and the ball-shape valve body selectively engages a valve seat defined by the spool in surrounding relation to said second connection passage to selectively block flow through said second connection passage.

15. The valve timing control apparatus according to claim 14, wherein:

said second check valve is provided with a pressing member provided in the second connection passage, the pressing member pressing the valve body to the valve seat by compression deformation.

16. The valve timing control apparatus according to claim 14, wherein:

the first drain passage and the second drain passage communicate with each other.

* * * * *